US005723240A

United States Patent [19]

Allen

[11] Patent Number: 5,723,240

[45] Date of Patent: Mar. 3, 1998

[54] METHOD FOR CONTROLLING THE FORMATION OF TONER IMAGES WITH TWO DISTINCT TONERS

[75] Inventor: Richard G. Allen, Rochester, N.Y.

[73] Assignee: Eastman Kodak Company, Rochester, N.Y.

[21] Appl. No.: 654,953

[22] Filed: May 29, 1996

[51] Int. Cl.[6] ..... G03G 13/00

[52] U.S. Cl. ..... 430/54; 430/45; 430/120

[58] Field of Search ..... 430/45, 54, 120

[56] References Cited

U.S. PATENT DOCUMENTS

| | | | |
|---|---|---|---|
| 4,473,029 | 9/1984 | Fritz et al. | 118/657 |
| 4,531,832 | 7/1985 | Kroll et al. | 355/3 DD |
| 4,860,048 | 8/1989 | Itoh et al. | 355/208 |
| 5,001,028 | 3/1991 | Mosehauer et al. | 430/45 |
| 5,045,893 | 9/1991 | Tabb | 355/328 |
| 5,049,949 | 9/1991 | Parker et al. | 355/328 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,260,752 | 11/1993 | Fuma et al. | 430/42 |
| 5,394,230 | 2/1995 | Kaukeinen et al. | 430/42 |
| 5,409,791 | 4/1995 | Kaukeinen et al. | 430/54 |
| 5,410,395 | 4/1995 | Parker et al. | 355/328 |

*Primary Examiner*—George F. Lesmes
*Assistant Examiner*—Laura Weiner
*Attorney, Agent, or Firm*—Norman Rushefsky

[57] ABSTRACT

The process control method for a DAD-CAD image forming method includes forming a DAD electrostatic image of a first polarity and applying toner of the first polarity to form a first toner image and then forming a CAD electrostatic image. To provide ample voltage for formation of the CAD image and to reduce scavenging, the development completion of the first electrostatic image is preferably kept below 0.4, preferably by reducing pole transitions provided by a rotatable magnetic core in toning the first image. The process is further controlled by adjusting an initial charge on the image member which also can be trimmed after formation of the first image by a uniform light exposure and by adjustment of AC biases in both toning steps.

24 Claims, 22 Drawing Sheets

| | | |
|---|---|---|
| BLACK | Ton Pot = | -290 |
| | AC Bias (kV P-P) = | 0 |
| | Core pf/s = | 250 |
| | Completion = | 0.35 |
| | Dt = | 1.15 |
| COLOR | Ton Pot = | 230 |
| | AC Bias (kV P-P) = | 0 |
| | Core pf/s = | 250 |
| | Completion = | 0.67 |
| | Dt = | 1.05 |
| | EL (ergs/cm^2) = | 0.00 |
| | Scav. Pot. (>50) = | 69 |
| | Disruption Pot. (>30) = | 96 |

COLOR DEVELOP

| | | | | |
|---|---|---|---|---|
| BLACK | Ton Pot = | -290 | -290 | -290 |
| | AC Bias (kV P-P) = | 0 | 0 | 0 |
| | Core pf/s = | 250 | 250 | 250 |
| | Completion = | 0.35 | 0.35 | 0.35 |
| | Dt = | 1.35 | 0.95 | 0.95 |
| COLOR | Ton Pot = | 230 | 230 | 230 |
| | AC Bias (kV P-P) = | 0 | 0.0 | 0.0 |
| | Core pf/s = | 250 | 250 | 250 |
| | Completion = | 0.69 | 0.61 | 0.61 |
| | Dt = | 1.13 | 0.85 | 0.85 |
| | EL (ergs/cm^2) = | 0.00 | 0.00 | 0.00 |
| | Scav. Pot. (>50) = | 68 | 68 | 70 |
| | Disruption Pot. (>30) = | 94 | 94 | 97 |

| FIG. 4A |
|---|
| FIG. 4B |

COLOR DEVELOP

| | | | | | |
|---|---|---|---|---|---|
| BLACK | Ton Pot = | -290 | -290 | -490 | -490 |
| | AC Bias (kV P-P) = | 0 | 0 | 0 | 0 |
| | Core pf/s = | 250 | 250 | 250 | 250 |
| | Completion = | 0.35 | 0.35 | 0.37 | 0.37 |
| | Dt = | 1.35 | 1.35 | 0.95 | 1.15 |
| COLOR | Ton Pot = | 229 | 229 | 229 | 229 |
| | AC Bias (kV P-P) = | 0 | 0.0 | 0.0 | 0.0 |
| | Core pf/s = | 250 | 250 | 250 | 250 |
| | Completion = | 0.69 | 0.62 | 0.62 | 0.67 |
| | Dt = | 1.13 | 0.85 | 0.85 | 1.05 |
| | EL (ergs/cm^2) = | 0.00 | 0.00 | 2.51 | 2.51 |
| | Scav. Pot. (>50) = | 68 | 68 | 104 | 1.03 |
| | Disruption Pot. (>30) = | 95 | 95 | 74 | 73 |

BLACK Q/m=-16
COLOR Q/m=7.4
-16
25
-28.1
7.4
-28.1
25
V film
POSITION
-700
-600
-500
-400
-300
-200
-100
0
BLACK DEVELOP
EL TRIM

COLOR DEVELOP

| | | | | |
|---|---|---|---|---|
| BLACK | Ton Pot = | -290 | -290 | -490 |
| | AC Bias (kV P-P) = | 0 | 0 | 0 |
| | Core pf/s = | 150 | 150 | 150 |
| | Completion = | 0.25 | 0.25 | 0.27 |
| | Dt = | 1.35 | 1.35 | 0.95 |
| COLOR | Ton Pot = | 218 | 261 | 261 |
| | AC Bias (kV P-P) = | 0 | 0.0 | 0.0 |
| | Core pf/s = | 350 | 350 | 350 |
| | Completion = | 0.76 | 0.61 | 0.61 |
| | Dt = | 1.25 | 0.85 | 0.85 |
| | EL (ergs/cm^2) = | 0.65 | 0.00 | 2.51 |
| | Scav. Pot. (>50) = | 95 | 65 | 106 |
| | Disruption Pot. (>30) = | 74 | 72 | 55 |

| | | | | |
|---|---|---|---|---|
| BLACK | Ton Pot = | -490 | -490 | -490 |
| | AC Bias (kV P-P) = | 0 | 0 | 0 |
| | Core pf/s = | 150 | 150 | 150 |
| | Completion = | 0.27 | 0.27 | 0.27 |
| | Dt = | 0.95 | 0.95 | 0.95 |
| COLOR | Ton Pot = | 261 | 216 | 261 |
| | AC Bias (kV P-P) = | 0.0 | 0.0 | 0.0 |
| | Core pf/s = | 350 | 350 | 350 |
| | Completion = | 0.61 | 0.76 | 0.61 |
| | Dt = | 0.85 | 1.24 | 0.85 |
| | EL (ergs/cm^2) = | 2.51 | 3.10 | 2.51 |
| | Scav. Pot. (>50) = | 106 | 118 | 106 |
| | Disruption Pot. (>30) = | 55 | 57 | 55 |

BLACK Q/m = -19
COLOR Q/m = 14
-19
19.2
-26.3
14
-26.3
19.2
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -290 | -290 | -490 | -490 |
| | AC Bias (kV P-P) = | 0 | 0 | 0 | 0 |
| | Core pf/s = | 150 | 150 | 150 | 150 |
| | Completion = | 0.25 | 0.25 | 0.27 | 0.27 |
| | Dt = | 1.15 | 1.15 | 1.15 | 1.15 |
| COLOR | Ton Pot = | 218 | 261 | 216 | 261 |
| | AC Bias (kV P-P) = | 0 | 0.0 | 0.0 | 0.0 |
| | Core pf/s = | 350 | 350 | 350 | 350 |
| | Completion = | 0.70 | 0.66 | 0.70 | 0.66 |
| | Dt = | 1.05 | 1.05 | 1.05 | 1.05 |
| | EL (ergs/cm^2) = | 0.65 | 0.00 | 3.10 | 2.51 |
| | Scav. Pot. (>50) = | 96 | 66 | 117 | 104 |
| | Disruption Pot. (>30) = | 76 | 74 | 55 | 53 |

BLACK Q/m = -19
COLOR Q/m = 19
-19
24.4
-25.8
19
-25.8
24.4
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -290 | -290 | -290 | -290 |
| | AC Bias (kV P-P) = | 0 | 0 | 1.3 | 1.3 |
| | Core pf/s = | 150 | 150 | 150 | 150 |
| | Completion = | 0.25 | 0.25 | 0.40 | 0.40 |
| | Dt = | 1.15 | 1.15 | 1.15 | 1.15 |
| COLOR | Ton Pot = | 260 | 260 | 260 | 260 |
| | AC Bias (kV P-P) = | 0 | 2.0 | 0.0 | 2.0 |
| | Core pf/s = | 350 | 350 | 350 | 350 |
| | Completion = | 0.66 | 0.85 | 0.66 | 0.85 |
| | Dt = | 1.05 | 1.05 | 1.05 | 1.05 |
| | EL (ergs/cm^2) = | 0.00 | 0.00 | 0.00 | 0.00 |
| | Scav. Pot. (>50) = | 67 | 67 | 25 | 25 |
| | Disruption Pot. (>30) = | 75 | 75 | 62 | 62 |

BLACK Q/m=-16
COLOR Q/m=13.2
-16
30.5
-29.5
13.2
-29.5
30.5
V film
-700
-600
-500
-400
-300
-200
-100
0
POSITION
BLACK DEVELOP
EL TRIM

COLOR DEVELOP

| | | | | | |
|---|---|---|---|---|---|
| BLACK | Ton Pot = | -290 | -290 | -290 | -290 |
| | AC Bias (kV P-P) = | 0 | 0 | 1.3 | 1.3 |
| | Core pf/s = | 150 | 150 | 150 | 150 |
| | Completion = | 0.25 | 0.25 | 0.41 | 0.41 |
| | Dt = | 1.35 | 1.35 | 0.95 | 0.95 |
| COLOR | Ton Pot = | 260 | 260 | 260 | 260 |
| | AC Bias (kV P-P) = | 0 | 2.0 | 0.0 | 2.0 |
| | Core pf/s = | 350 | 350 | 350 | 350 |
| | Completion = | 0.70 | 0.83 | 0.70 | 0.83 |
| | Dt = | 1.25 | 0.85 | 1.25 | 0.85 |
| | EL (ergs/cm^2) = | 0.00 | 0.00 | 0.00 | 0.00 |
| | Scav. Pot. (>50) = | 66 | 66 | 20 | 20 |
| | Disruption Pot. (>30) = | 73 | 73 | 62 | 62 |

BLACK Q/m = -19.4
COLOR Q/m = 10
-19.4
25
-33.3
10
-33.3
25
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -298 | -298 | -485 | -485 |
| | AC Bias (kV P-P) = | 0 | 0 | 1.3 | 1.3 |
| | Core pf/s = | 150 | 150 | 150 | 150 |
| | Completion = | 0.25 | 0.25 | 0.42 | 0.42 |
| | Dt = | 1.15 | 1.15 | 1.15 | 1.15 |
| COLOR | Ton Pot = | 193 | 270 | 192 | 270 |
| | AC Bias (kV P-P) = | 0 | 2.0 | 0.0 | 2.0 |
| | Core pf/s = | 350 | 350 | 350 | 350 |
| | Completion = | 0.74 | 0.85 | 0.74 | 0.85 |
| | Dt = | 1.05 | 1.05 | 1.05 | 1.05 |
| | EL (ergs/cm^2) = | 1.10 | 0.00 | 3.43 | 2.38 |
| | Scav. Pot. (>50) = | 112 | 63 | 76 | 47 |
| | Disruption Pot. (>30) = | 77 | 74 | 36 | 35 |

BLACK Q/m = -16.5
COLOR Q/m = 10
-16.5
31
-35.3
10
-35.3
31
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -298 | -298 | -485 | -485 |
| | AC Bias (kV P-P) = | 0 | 0 | 1.3 | 1.3 |
| | Core pf/s = | 150 | 150 | 150 | 150 |
| | Completion = | 0.25 | 0.25 | 0.43 | 0.43 |
| | Dt = | 1.35 | 1.35 | 0.95 | 0.95 |
| COLOR | Ton Pot = | 193 | 270 | 192 | 270 |
| | AC Bias (kV P-P) = | 0 | 2.0 | 0.0 | 2.0 |
| | Core pf/s = | 350 | 350 | 350 | 350 |
| | Completion = | 0.74 | 0.83 | 0.74 | 0.83 |
| | Dt = | 1.05 | 0.85 | 1.05 | 0.85 |
| | EL (ergs/cm^2) = | 1.10 | 0.00 | 3.43 | 2.38 |
| | Scav. Pot. (>50) = | 111 | 62 | 75 | 46 |
| | Disruption Pot. (>30) = | 76 | 73 | 37 | 36 |

BLACK Q/m = -19.4
COLOR Q/m = 10
-19.4
25
-33.3
10
-33.3
25
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -298 | -298 | -485 | -485 |
| | AC Bias (kV P-P) = | 0 | 0 | 1.3 | 1.3 |
| | Core pf/s = | 150 | 150 | 150 | 150 |
| | Completion = | 0.25 | 0.25 | 0.42 | 0.42 |
| | Dt = | 1.15 | 1.15 | 1.15 | 1.15 |
| COLOR | Ton Pot = | 192 | 272 | 191 | 268 |
| | AC Bias (kV P-P) = | 0 | 2.0 | 0.0 | 2.0 |
| | Core pf/s = | 350 | 350 | 350 | 350 |
| | Completion = | 0.74 | 0.85 | 0.74 | 0.85 |
| | Dt = | 1.05 | 1.06 | 1.05 | 1.05 |
| | EL (ergs/cm^2) = | 0.00 | 0.00 | 0.00 | 0.00 |
| | Scav. Pot. (>50) = | 141 | 62 | 198 | 121 |
| | Disruption Pot. (>30) = | 149 | 73 | 261 | 202 |

BLACK Q/m = -19.4
COLOR Q/m = 10
-19.4
25
-33.3
10
-33.3
25
V film
POSITION
-700
-600
-500
-400
-300
-200
-100
0
BLACK DEVELOP
EL TRIM

COLOR DEVELOP

| | | | | | |
|---|---|---|---|---|---|
| BLACK | Ton Pot = | -298 | -298 | -485 | -485 |
| | AC Bias (kV P-P) = | 0 | 0 | 1.3 | 1.3 |
| | Core pf/s = | 150 | 150 | 150 | 150 |
| | Completion = | 0.25 | 0.25 | 0.42 | 0.42 |
| | Dt = | 1.15 | 1.15 | 1.15 | 1.15 |
| COLOR | Ton Pot = | 191 | 268 | 192 | 270 |
| | AC Bias (kV P-P) = | 0 | 2.0 | 0.0 | 2.0 |
| | Core pf/s = | 350 | 350 | 350 | 350 |
| | Completion = | 0.74 | 0.85 | 0.74 | 0.85 |
| | Dt = | 1.05 | 1.05 | 1.05 | 1.05 |
| | EL (ergs/cm^2) = | 1.14 | 0.00 | 2.88 | 1.85 |
| | Scav. Pot. (>50) = | 112 | 65 | 103 | 69 |
| | Disruption Pot. (>30) = | 76 | 76 | 76 | 75 |

METHOD FOR CONTROLLING THE FORMATION OF TONER IMAGES WITH TWO DISTINCT TONERS

This invention relates to the formation of toner images of two distinct toners, for example, toners of two different colors. More specifically, it relates to a method of controlling such image formation.

U.S. Pat. No. 5,001,028 to Mosehauer et al, issued Mar. 19, 1991, is representative of a large number of patents which show the creation of multicolor toner images by creating two unfixed images on a single frame of a photoconductive image member. Color printers have been marketed using this general approach, using discharged area development (DAD) and electronic exposure for each image.

In the Mosehauer patent the second and subsequent images are toned with a particular toning process using high coercivity carrier and a rotating magnetic core. This process provides a very soft magnetic brush which disturbs the earlier toner images less than an ordinary magnetic brush, even though the brush strands may be allowed to contact the image member.

A few references suggest a mixture of discharged area development and charged area development (DAD and CAD). For example, see U.S. Pat. No. 5,045,893 to Tabb, granted Sep. 3, 1991, in which a photoconductive image member is uniformly charged to a negative potential and is exposed to a DAD image. The DAD image is developed with a toner of a negative potential and a "high resolution development system" which uses about 50 percent of the original voltage on the photoconductor. The image member is then re-exposed to a CAD image with the background portions of the CAD image exposed to about the level of voltage of the first toner image. The CAD image is then developed with positively charged particles using a less expensive toning system. Other mixtures of CAD and DAD are shown in U.S. Pat. Nos. 5,208,636; 5,241,356; 5,049,949; and 5,258,820.

U.S. patent application Ser. No. 08/583,732, entitled "METHOD FOR FORMING TONER IMAGES WITH TWO DISTINCT TONERS," to E. C. Stelter et al, filed Jan. 17, 1996 discusses the problem of "scavenging" of first image toner into the second station. This is a problem well documented in prior DAD-DAD imaging systems. The Stelter et al application suggests substantial reduction in scavenging in a DAD-CAD process when the second station uses the same magnetic brush toning station disclosed in the Mosehauer patent. This application also discusses a problem associated with line images having a tendency to lose their resolution. This problem is solved according to this application by making the second exposure from the side of the image member opposite that containing the first toner image to discharge the first toner image to a level substantially below that of the untoned portions (which also helps reduce scavenging). This resolution problem can be termed "disruption" of the first toner image by the second exposure.

As if the problems of scavenging and disruption were not enough, the person designing a successful DAD-CAD system for general use must generally deal with two different toners having varying responses to varying ambient conditions. It is well known that the charge-to-mass ratio (sometimes just called the "charge" or "relative charge") of many toner particles in two-component mixtures varies substantially with variations in relative humidity, temperature and other conditions. A higher charge-to-mass (Q/M) provides lower density for a given amount of surface potential in developing an electrostatic image. Variations in humidity not only occur seasonally, but, more seriously, occur daily. A high volume image forming apparatus may take two to three hours to reach a steady temperature after being turned on. This can result in a 30 percent change in relative humidity over a period in which many images are normally made. It is well known to analyze a developed toner patch with a densitometer to determine the image density at a particular voltage level which, in turn, can be used to estimate the charge on the toner.

A further complication that can be added to such systems is a desire for extremely high quality imaging using multilevel exposure, commonly called "gray level" exposure or imaging. Gray level imaging requires more voltage space in which to provide the various levels than does binary imaging, which further complicates problems associated with scavenging and disruption. These problems will become more clear in the discussion that follows.

SUMMARY OF THE INVENTION

It is an object of the invention to provide a method of controlling such prior multiple toner image systems. According to a preferred embodiment, it is an object to optimize density in conditions of varying toner charge (Q/M) while minimizing scavenging and disruption in a DAD-CAD system.

These and other objects are accomplished by a method of control which optimizes the development or toning completion of each image, the original charge on an image member, adjustment of development bias, and/or a potential trimming exposure between images. Each of these aspects can be used separately to advantage, but are much more effective when used together.

According to a preferred embodiment, in a DAD-CAD system, the method provides less development completion in toning the first image than in toning the second image. Preferably, the development completion of the first electrostatic image is kept below 0.4, even more preferably, below 0.3. This provides more voltage room to both develop the second toner image and to provide potential to resist scavenging. According to a preferred embodiment, such developer completion is provided primarily by providing a different pole transition rate in developing the two electrostatic images using a development system of a type similar to that described in the above Mosehauer et al patent. According to another preferred embodiment, development completion is varied by varying an AC component to a development field.

In another preferred embodiment, the original charge on the image member is varied, primarily to control density in the first (DAD) toner image in conditions of changing Q/M.

According to another preferred embodiment, a trim exposure is available after completion of development of the first image to further control the process. The trim exposure is especially useful when the original charge on the photoconductor has been increased in conditions of high first toner charge. The trim exposure removes that high charge before the second development. It is also usable in conditions of very low charge on the second toner. In both instances, the trim prevents excess density in the second toner image. The trim may be accomplished by a separate illumination source, such as a backside EL panel or by the second exposure device.

Although the trim may be used to provide imaging space with a constant second development station bias, it is more effective in a preferred embodiment in which the bias on the second station is also adjusted according to the trimmed voltage to provide less disruption and scavenging.

As will be explained in more detail below using these available adjustments, scavenging and disruption can be kept to a minimum and density maintained at a desired level through a relatively broad range of conditions associated with both the first and second toners.

DETAILED DESCRIPTION OF THE INVENTION

Figure 1:
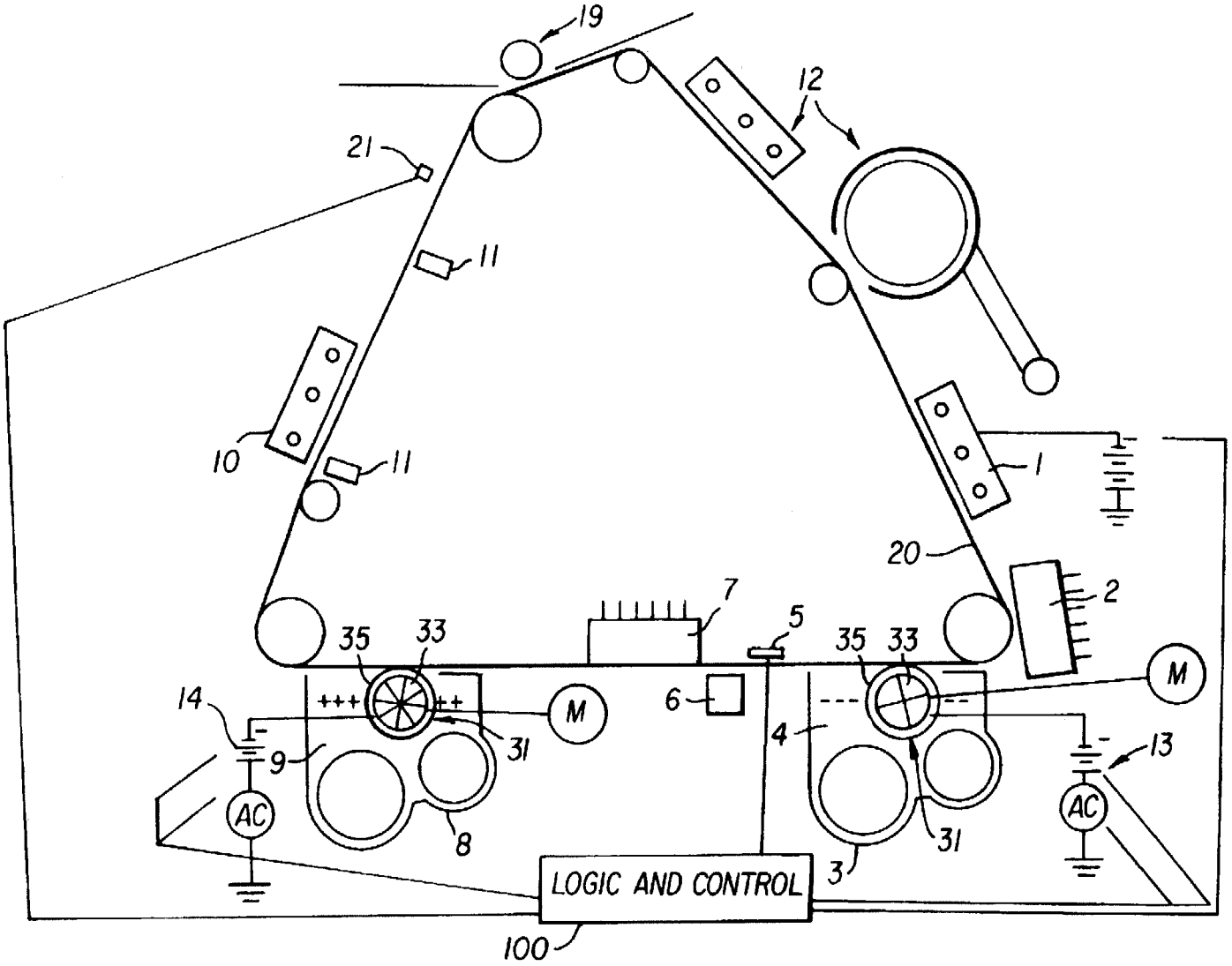
FIG. 1 is a side schematic of an image forming apparatus.

FIG. 1 is a schematic of an image forming apparatus usable in a DAD-CAD process. Referring to FIG. 1, a photoconductive image member 20 is uniformly charged to a charge of a first potential $V_0$ by a charger 1. For some embodiments, it is preferred that photoconductive image member 20 be transparent to actinic radiation. Although the charge could be either negative or positive, for illustrative purposes, it will be described as negative. The charged image member is imagewise exposed at an exposure device, for example, an LED printhead 2, to create a first electrostatic image having a minimum potential $V_e$. A toner of the first polarity, in this case negatively charged toner 4, is applied to the first electrostatic image by a development or toning station 3 in the presence of an electric field created between the station 3 and the image member 20 and controlled by a bias applied by a first source of potential 13. The source of potential 13 preferably includes DC and AC components, with the DC component setting a development bias $V_b$ for first toning station 3. A controlled light source, for example, an EL panel 5, is positioned behind image member 20 (the side opposite the toner image) and is usable to trim the charge on the image member after the image member leaves the first toning station 3. The image member also passes under a conventional interframe and format erase device 6 positioned on the frontside of the image member 20.

The image member 20 is, again, imagewise exposed to form a second electrostatic image at an exposure station, for example, an LED printhead 7, located on the side of the image member opposite the first toner image. (All of the functions of components 5 and 6 could alternatively be accomplished by printhead 7, but there are reliability advantages to separating them.) The second electrostatic image has a minimum potential outside the first toner image $V_e'$. It is toned by the application of a second toner 9 of a second polarity (positive), opposite the first polarity, from a second development or toning station 8 in the presence of an electric field created between station 8 and the image member by a second source of potential 14. The electric field includes a DC component or second bias $V_b'$, and can include an AC component, as shown. A second toner image is, thus, formed, which second toner image is of the second polarity and has a minimum potential $V_d'$.

As the image member 20 exits the second toning station 8, it contains a toner image containing two different types of toner. Usually this image is a two color image in which the first toner is black and the second toner is a highlight color such as red, yellow or blue. However, the process can be used with any color of toner in either station or even two toners of the same color to advantage. For example, the first toner could be a black, nonmagnetic toner and the second toner a black, magnetic toner for use in MICR systems.

The toner image contains toner of opposite polarities. A corona device 10 and erase lamps 11 are used to, as much as possible, change the toners to a single polarity so that they can be transferred at a transfer station 19 to a receiving sheet using normal electrostatic transfer forces. The receiving sheet is separated from the image member, transported to a fuser for fixing (not shown), and further fed into some sort of an output tray (not shown). The image member is cleaned, using a preclean charger and cleaning device 12 for reuse in the system.

Toning stations 3 and 8 are each constructed according to technology explained in more detail in U.S. Pat. No. 5,001,028, referred to above, which patent is hereby incorporated by reference herein. Briefly, each station includes an applicator 31 having a rotatable, magnetic core 33 within a shell 35 which also may be rotatable. Toners 4 and 9 are part of a two component mixture (developer) including high coercivity (hard) magnetic particles. Rotation of the core and shell moves the developer through a development zone in the presence of the electrical field from sources of potential 13 and 14. The term "development zone" implies a location wherein development of an electrostatic image occurs. Development completion of electrostatic images moving on image member 20 at any given speed is affected by the number of pole transitions in the development zone caused by the rotating core. This, in turn, is a function of both the number of poles in the core and its speed of rotation. As will be discussed later, low development completion in the first station and high development completion in the second station can be obtained by rotating the second core faster than the first or providing more poles on the second core. An adjustment in shell speed is useful to move the developer at the speed of the image member in both instances. A logic and control 100 controls the system, as will be explained in more detail below.

Figure 2:
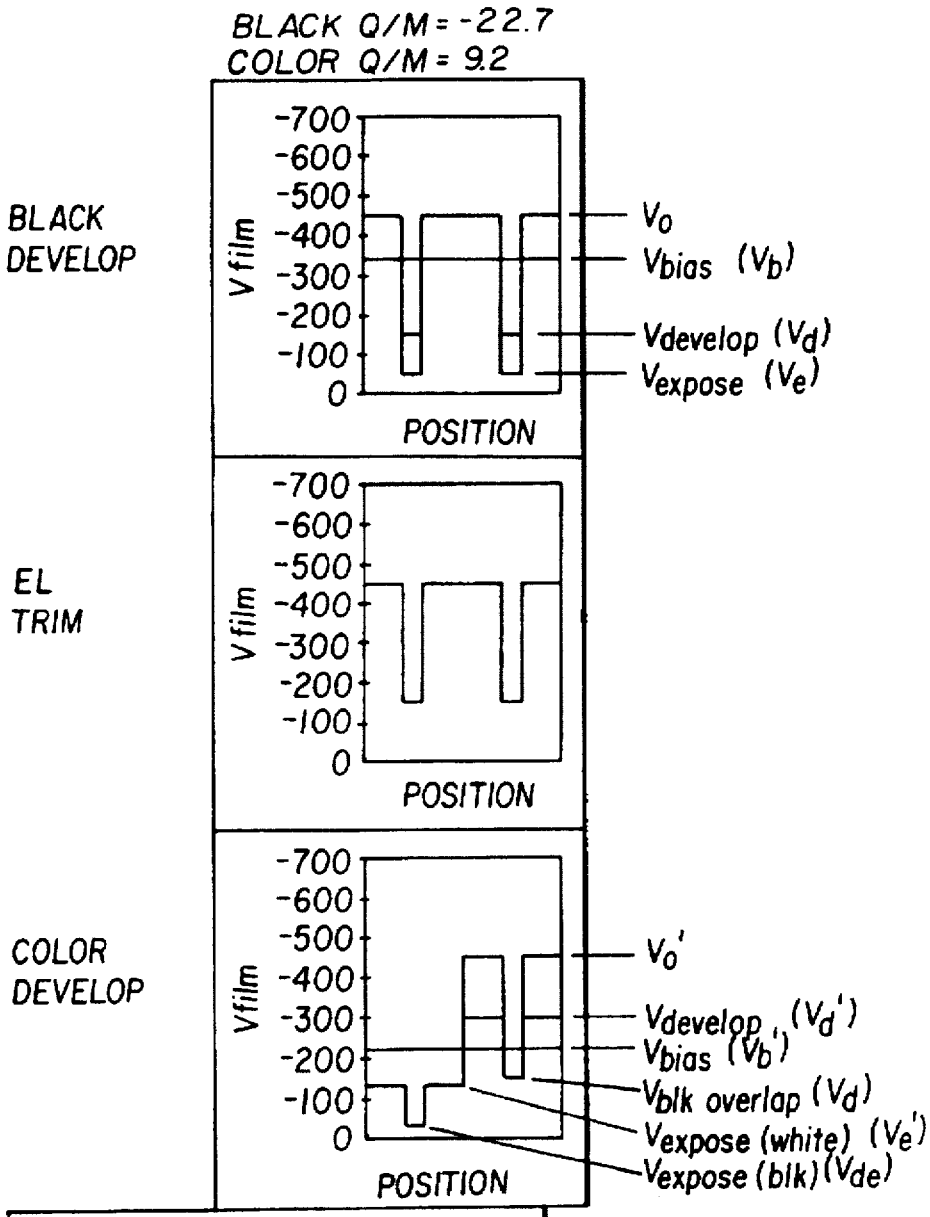
FIGS. 2–12 are sets of graphs illustrating different embodiments of the invention in terms of the voltage across the photoconductive image member and accompanying charts explaining the graphs.

FIGS. 2–12 include both graphs and charts illustrating the invention. FIG. 2 is used to explain in detail both the nomenclature used and the problems faced in controlling an image forming method carded out by the FIG. 1 apparatus. In each of the FIGS. 2–12, the voltage on the image member (labeled as Vfilm in the graphs) is plotted against a position across the image member. In the FIG. 2 embodiment a black toner having a Q/M=–22.7 μC/g is the first toner and is placed in toning station 3 and a color toner having a Q/M=9.2 μC/g is placed in the second toning station 8. Both toners are mixed with a high coercivity carrier making a two component developer. The original voltage applied by charger 1, $V_0$ is equal to –450 volts. The darkest (intended) portions of the image are exposed to a minimum voltage $V_e$ of about 50 volts by printhead 2. Toning (development) is accomplished using a magnetic brush having a rotating core, as described above, which core is rotated at a speed providing 250 pole transitions per second in the development zone. The magnetic brush is biased by source 13 to a direct current level $V_b$ of approximately –340 volts with no AC component. With these parameters, the first toning station 3 has a total toning potential $V_e$–$V_b$ equal to –290 volts. With the image member moving at a speed of 0.4375 meters per second (17.5 inches per second), the minimum voltage areas of the image are toned up to a potential $V_d$ of about –150 volts. The completion of toning or development is equal to $$\frac{V_d - V_e}{V_b - V_e},$$

in this case 0.35. This provides a transmission density $D_t$ (black) for the materials used equal to 1.15. This is shown in the top graph (labeled "Black Develop") in FIG. 2 with some of the values given in the box labeled "Black" in the chart in FIG. 2. The middle graph in FIG. 2 shows the voltage position of the image member prior to the second exposing step. It is labeled "EL trim" because of a trim step in later examples.

The bottom graph (labeled "Color Develop") in FIG. 2 illustrates the second exposure and toning steps for the second toner (in this example, the color toner). The voltage $V_0'$ in the unexposed areas entering the second exposure station remains equal to $V_0$ (ignoring dark decay for simplicity of explanation) at −450 volts. The color image is exposed for CAD development with the expected background, or white areas, exposed down to a minimum potential $V_e'$ of about −130 volts. Because this exposure is through the base, it also reduces the voltage on the black image to a very low level $V_{de}$ of approximately −30 volts. Another portion of the black image is not exposed in this step because of an overlap (generally not intended) of the black and color images. This portion of the black image remains at $V_d$ after the color exposure. Extremely high quality registration of the images may eliminate this overlap, but usually it must be allowed for.

Using a magnetic brush essentially the same as that used in station 3 with the DC bias set at about −220 volts and a positive color toner having a Q/M equal to 9.2, a development completion of 0.67 can be obtained, bringing the voltage $V_d'$ in the most dense or highest potential areas of the color image down to about −300 volts.

The success of the control of this system can be analyzed in terms of resistance to some of the problems discussed above, including scavenging and disruption, as well as in terms of maintaining desired density despite varying toner Q/M. Scavenging is best analyzed by comparing the voltage in the overlap portion, $V_d$ in the bottom graph in FIG. 2 with the bias $V_b'$ in the second development station. This potential difference $V_b'-V_d$ resists both overtoning and scavenging where it is most likely to occur. It is preferred that it be in excess of 50 volts which will effectively prevent scavenging. However, it must still permit sufficient development latitude for a range of densities in the color image. In the FIG. 2 example with Q/M's as shown, the scavenging potential is 69 volts which is adequate to prevent an unacceptable amount of scavenging. The color toning potential ($V_0'-V_b'$) is 230 volts, which is also adequate for gray level imaging with a high development completion in the color toning step.

The disruption potential is calculated as the difference between $V_{de}$ and $V_e'$. This potential difference prevents the black image from migrating or jumping into the white space adjacent it after the color exposure brings the adjacent areas down toward the black voltage level. In the example in question, the disruption potential is 96 volts, which is adequate to maintain an undisrupted black image. At the same time, the density of the black image is 1.15, and that of the color image is 1.05, which is acceptable maximum density for these images in gray level imaging.

Figures 3, 3A, 3B:
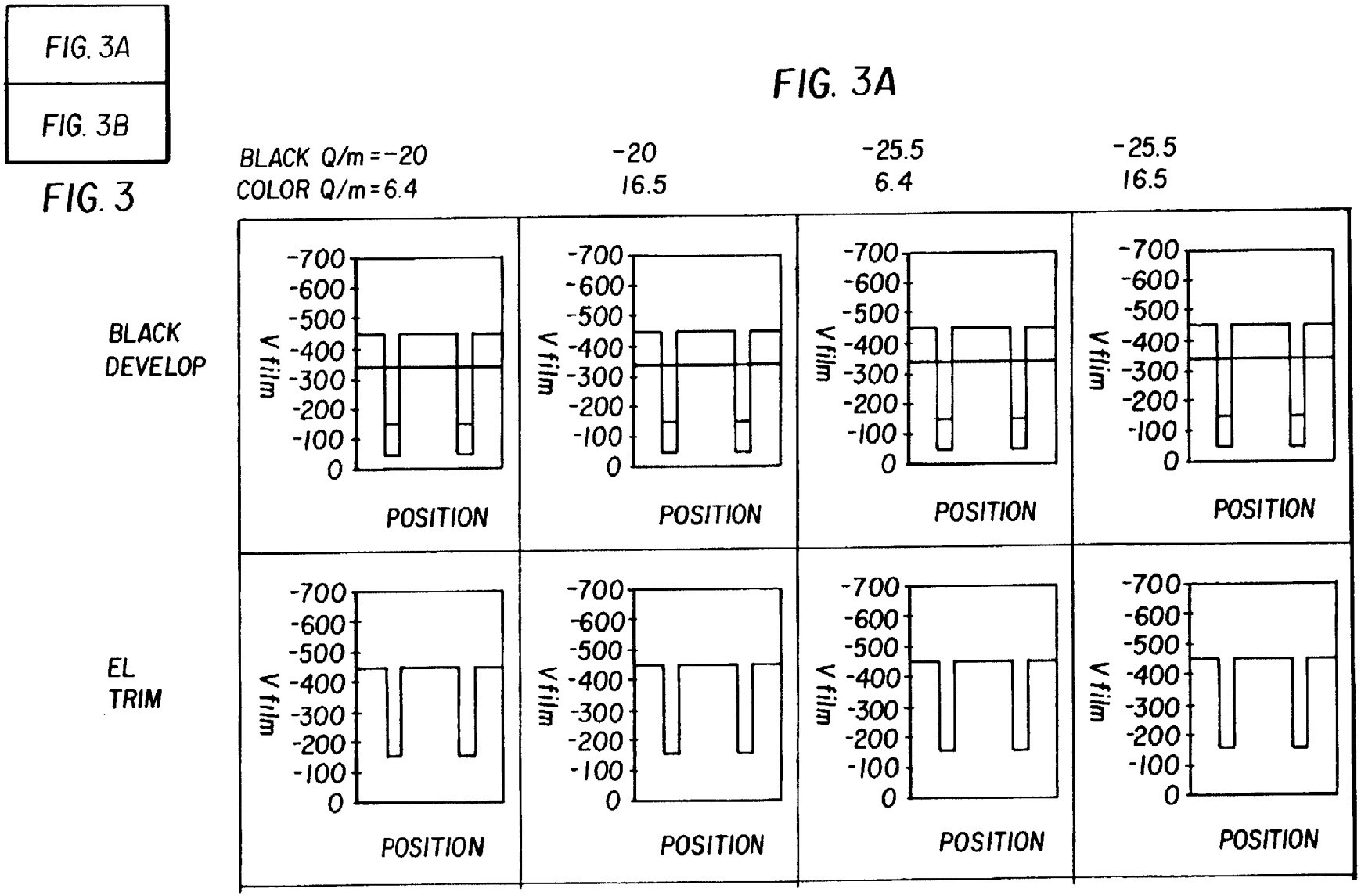
Figure 3B:
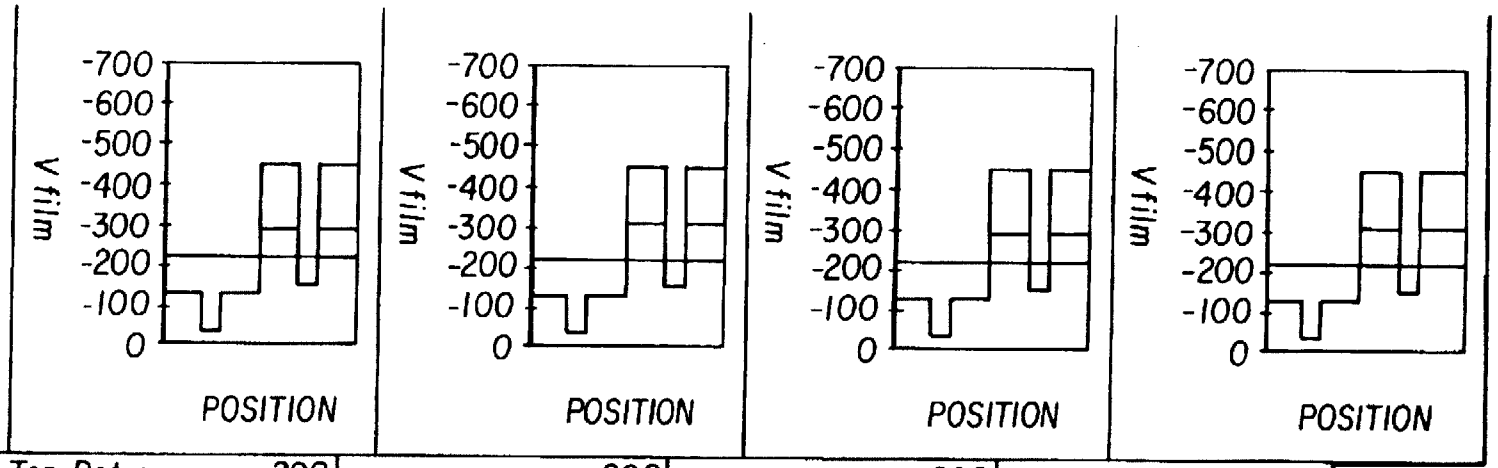

FIG. 3 illustrates experiments in which the same machine settings are used, as in FIG. 2, but with somewhat different Q/M's for the materials. More specifically, in the first two columns of graphs and charts, the black toner has a Q/M equal to −20 μC/g, and the last two columns equal to −25.5 μC/g. The first and third columns have a Q/M for the color equal to 6.4 μC/g, while the second and fourth columns have a Q/M of 16.5 μC/g. With these settings, the scavenging potential and disruption potentials continue to be approximately the same as for the examples shown in FIG. 2. However, there is a falloff in density where higher Q/M's are used.

Figures 4, 4A:
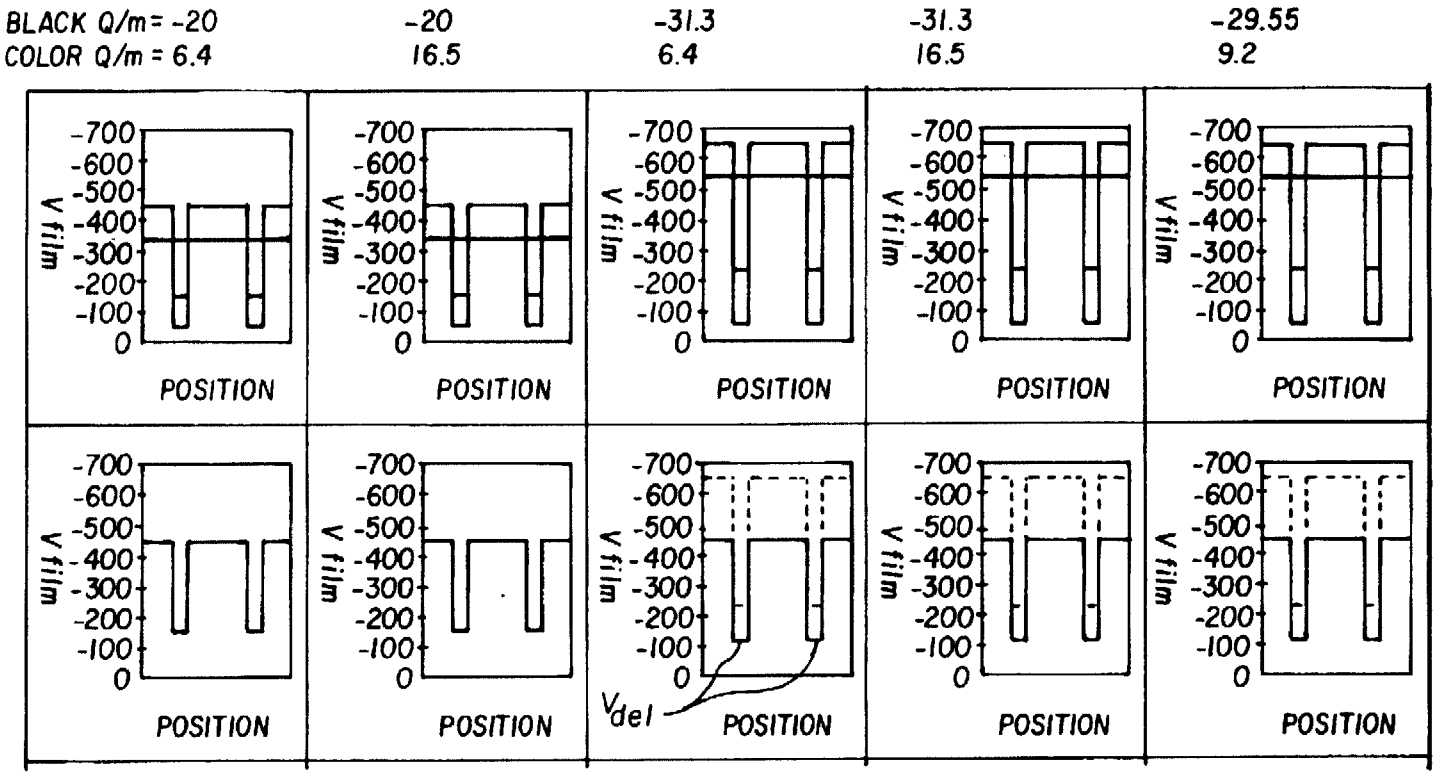
Figure 4B:
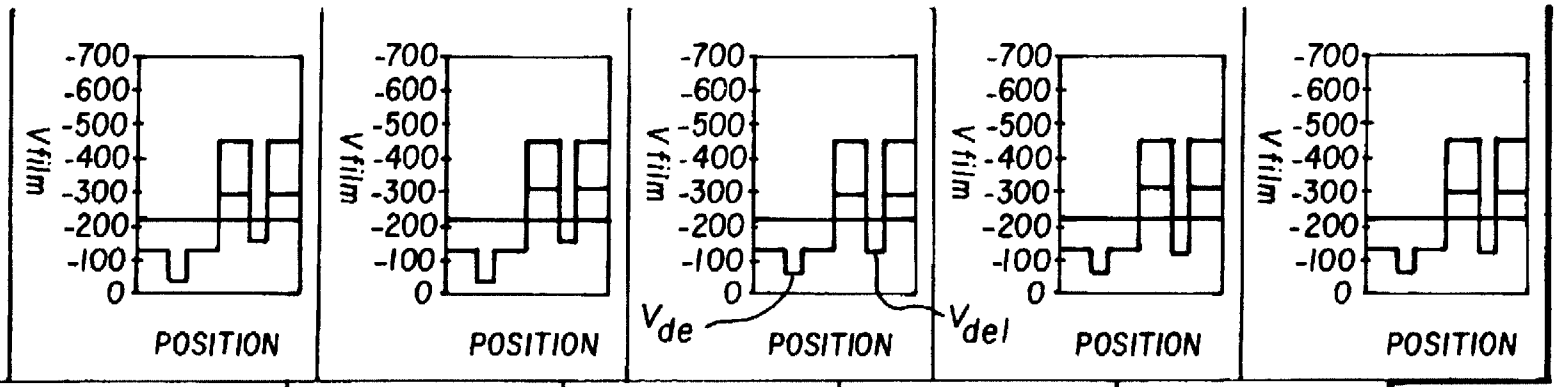

To expand the range of the system to higher Q/M's for the black toner, $V_0$ is varied as shown in FIG. 4. More specifically, when the Q/M of the black toner is −31.3, as in the third and fourth columns in FIG. 4, $V_0$ is increased to about −650 volts. This provides a toning potential of −490 volts which, in turn, provides a density of about 0.95 with 0.37 development completion.

To maintain comparable density in the color toner step (while maintaining a relatively low $V_b'$), the voltage on the image member is reduced after the black toning step by exposure to electroluminescent panel 5 in an amount shown in the lower portion of the chart in FIG. 4 equal to 2.51 ergs/cm$^2$. This exposure reduces the voltage from a $V_0$ of −650 volts to a $V_0'$ of −450 for color image formation, which was $V_0'$ in the earlier examples. In the black image areas, the residual charge on the image member from black image exposure, $V_e$, plus the charge from the charged toner deposit create a field $V_d$ which is further reduced when exposed from the side of the image member opposite the first image. Thus, as shown in the third column of FIG. 4, $V_d$ is reduced by the trim exposure to $V_{del}$ which ends up being the potential in the image overlap portion (comparable to $V_d$ in FIG. 2). $V_{de}$ in FIG. 4 has also been reduced by the trim exposure.

Comparable densities for color are then obtained in FIG. 4 to the FIG. 3 densities. Scavenging potential and disruption potential continues to be acceptable even with higher black Q/M. Note that $V_d$ in columns 3 and 4 is equal to $V_b'$. Thus, if the EL panel was not used, an unacceptable scavenging situation would persist where the images overlap. As a result of EL exposure, $V_{del}$ and $V_{de}$ are lower than in FIG. 3, providing good scavenging and disruption potentials even though black Q/M is higher in FIG. 4. The fifth column densities of 1.15 and 1.05 are obtained for black and color with −29.55 and 9.2 charge-to-mass ratios, respectively. For highest quality imaging, this may represent the limit of acceptable Q/M with these controls.

Figures 5, 5A, 5B:
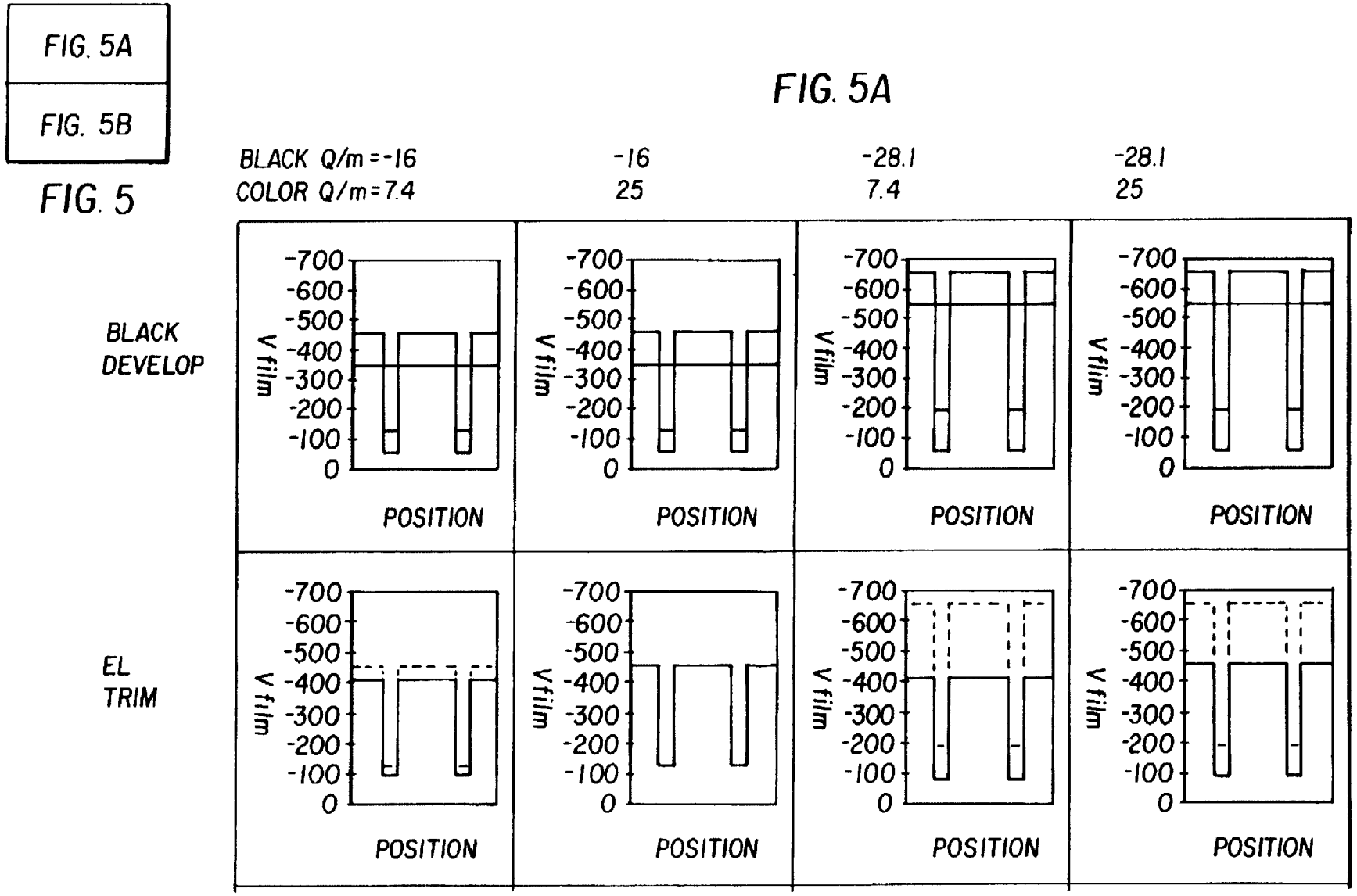
Figure 5B:
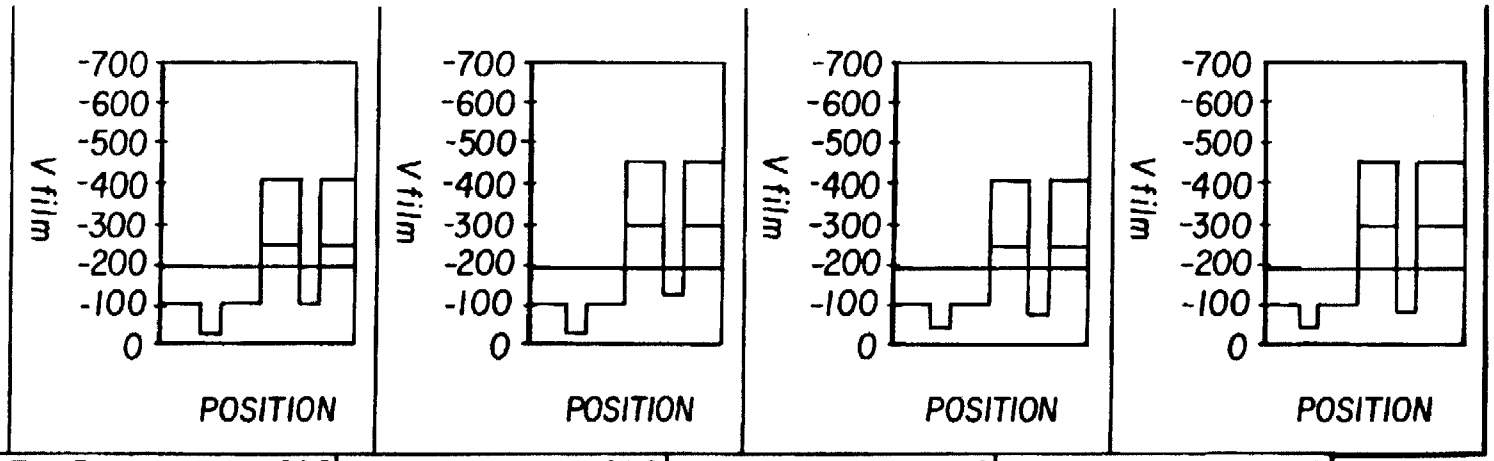
Figures 6, 6A, 6B:
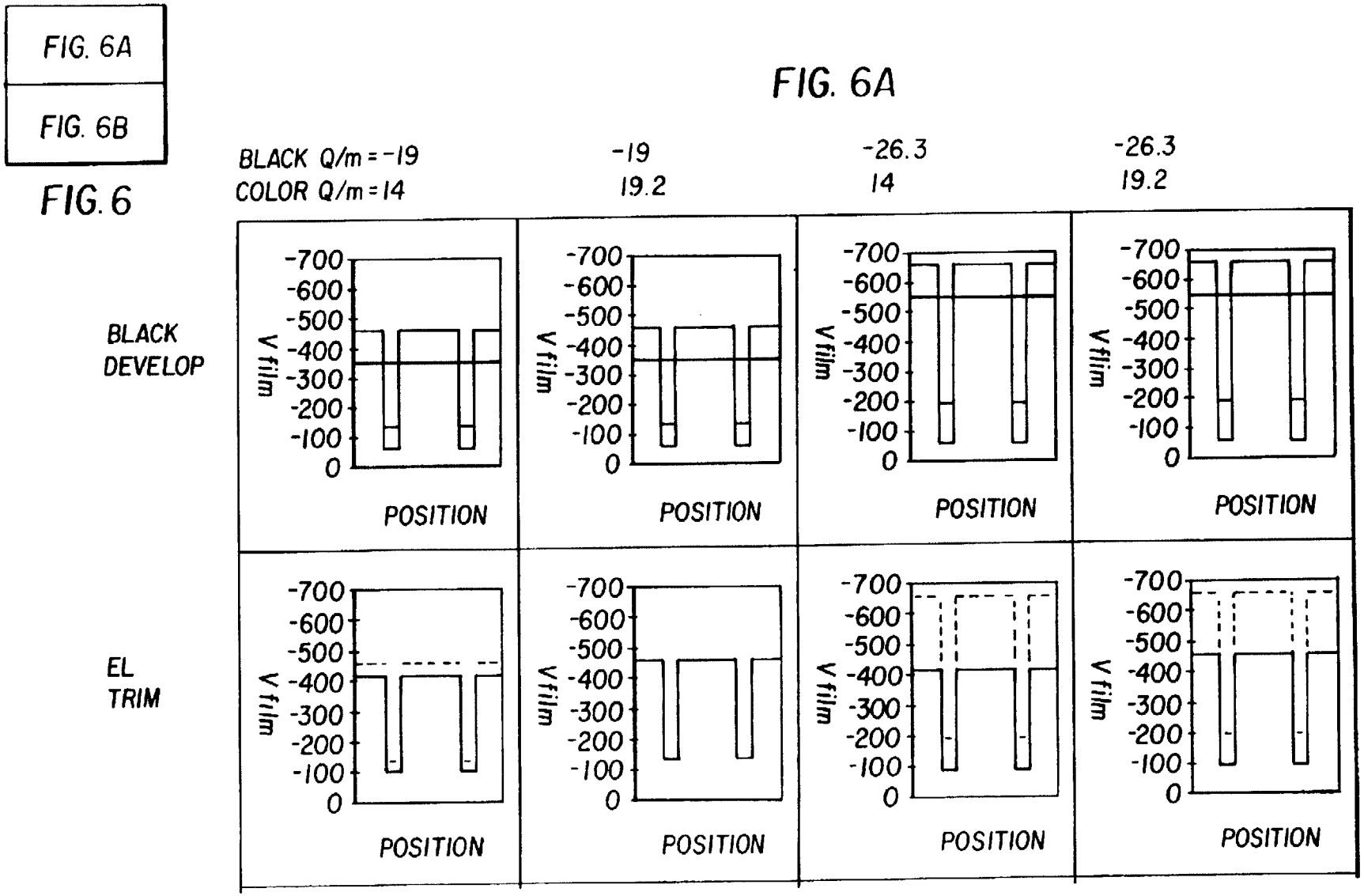
Figure 6B:
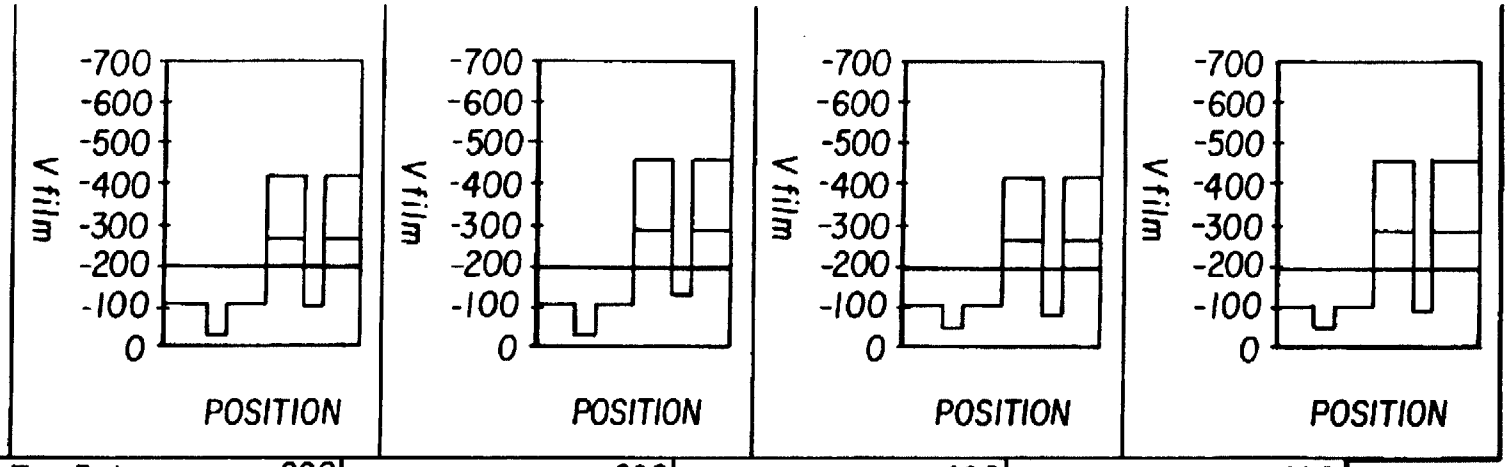

FIGS. 5 and 6 illustrate a further adjustment to improve the range of the system. In all of the examples shown in FIGS. 5 and 6 the pole transitions per second in the first station have been reduced to 150 and in the second station increased to 350. This has a tendency to reduce development completion in the black station while increasing development completion in the color station. As in FIG. 4, for a given higher black Q/M, to achieve black density, higher $V_0$ is used. $V_d$ is about the same as in prior examples, but a higher EL intensity results in a lower $V_{del}$. The resulting lower $V_{del}$ and $V_{de}$ helps keep the scavenging potential and disruption potential and densities acceptable for higher color toner Q/M conditions. This is accomplished at some loss of ability to handle very high Q/M in the black toner.

Further, FIGS. 5 and 6 illustrate that the electroluminescent panel can also be used to adjust $V_0'$ for variations in Q/M in the color toner. Note in this respect that the amount of trim is varied primarily according to the Q/M of the black but also somewhat according to the Q/M of the color toner. This has a tendency to reduce the density of the color toner in the low color Q/M conditions. With the adjustments made in FIG. 6, note that the results obtained are quite acceptable as the Q/M of the black toner varies from −19 to −26.3 μC/g and the Q/M of the color toner varies from 14 to 19 μC/g.

These are better results than in FIG. 4 where the magnetic brush in the second station provided the same pole transitions per second as did the first station. Thus, a fixed difference in developer completion from a fixed pole transition difference coupled with $V_0$ variation and trim variation responsive to Q/M has substantially expanded the range. Referring to FIG. 5, note that the results drop off with wide variations of the black toner from −16 to −28.1 and the color from 7.4 to 25 μC/g.

Figures 7, 7A, 7B:
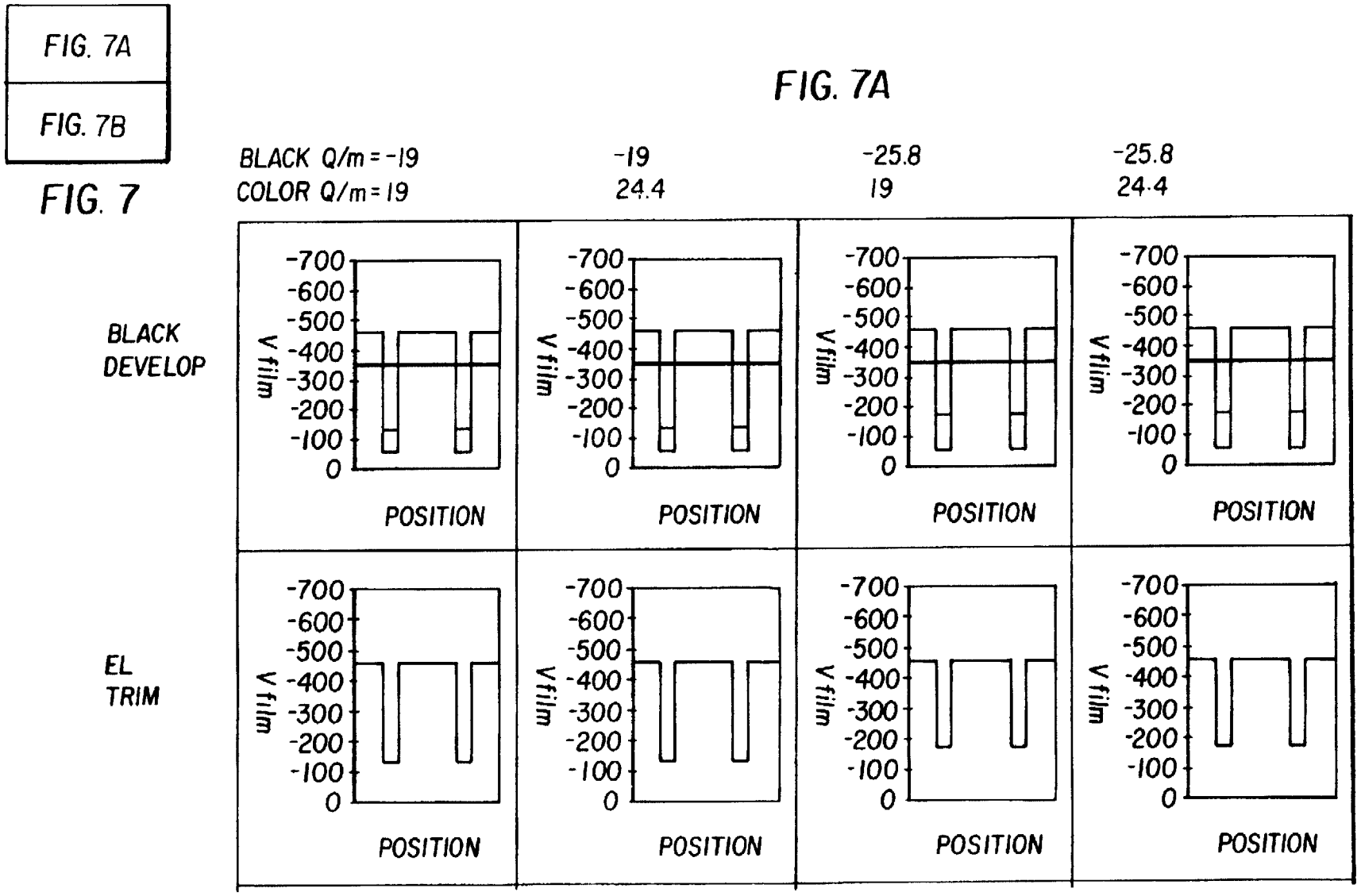
Figure 7B:
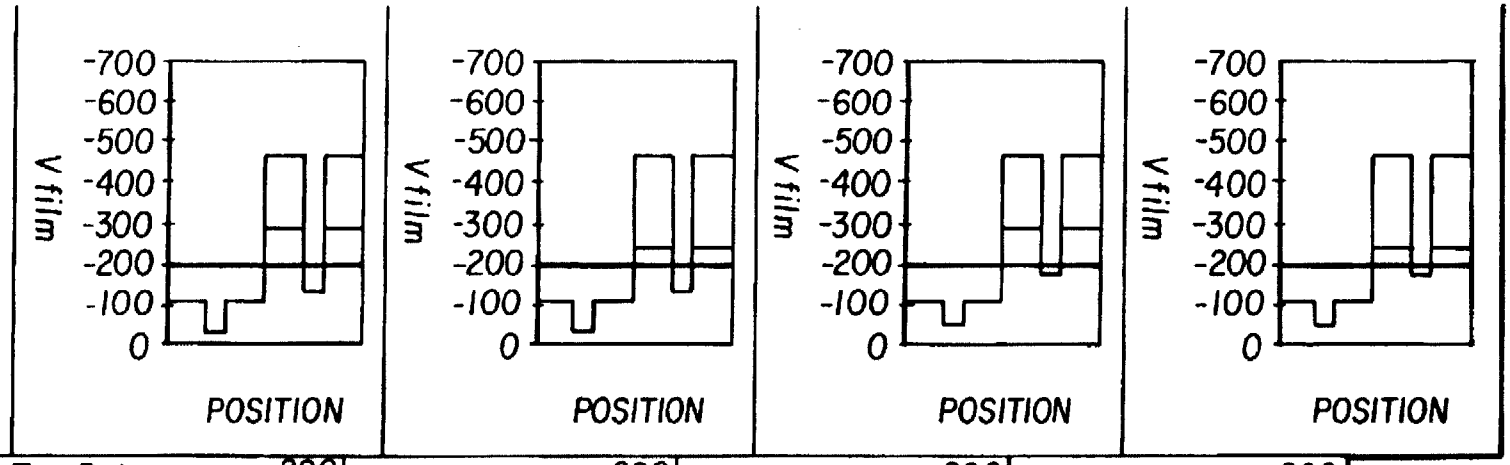
Figures 8, 8A, 8B:
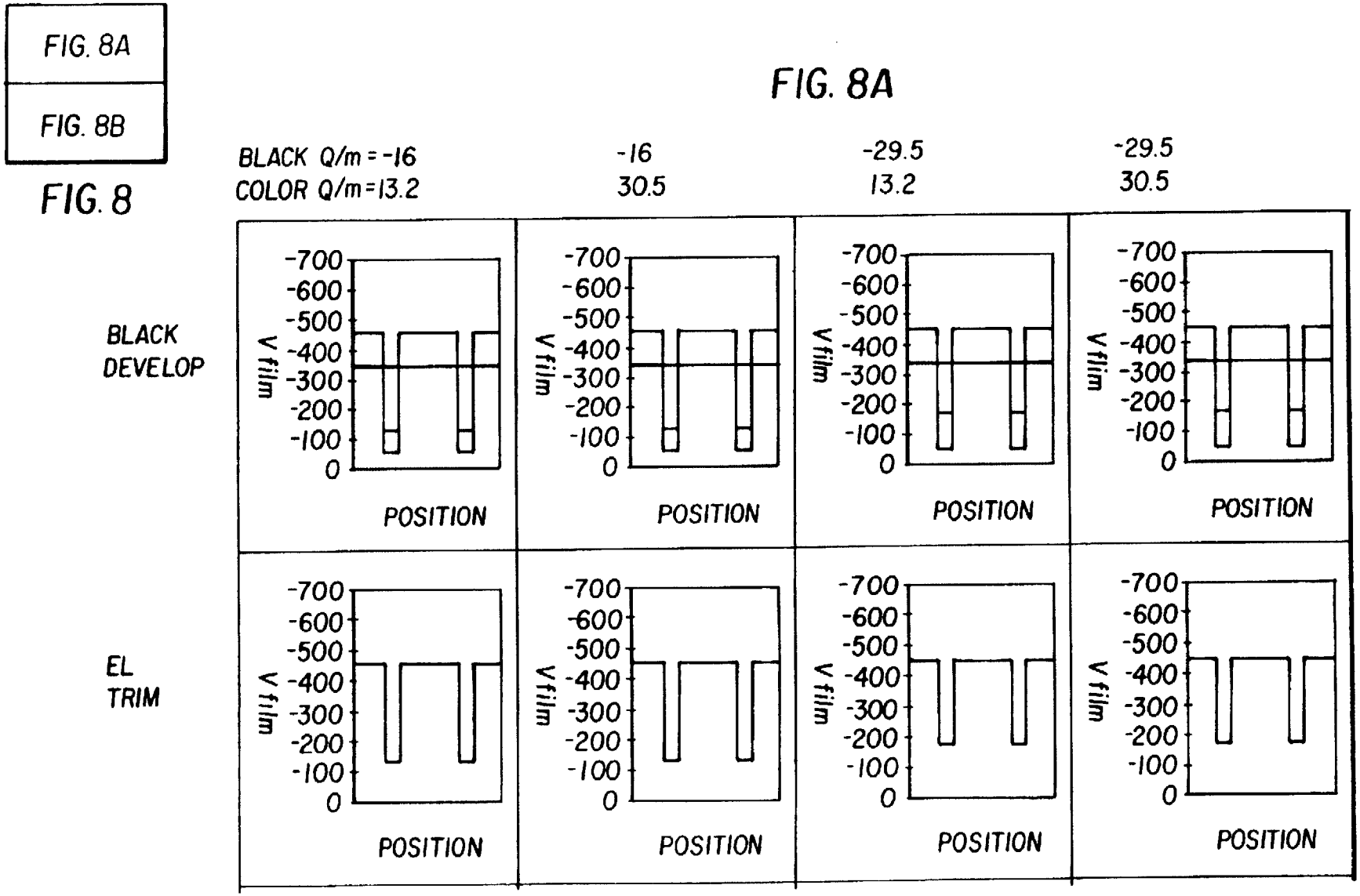
Figure 8B:
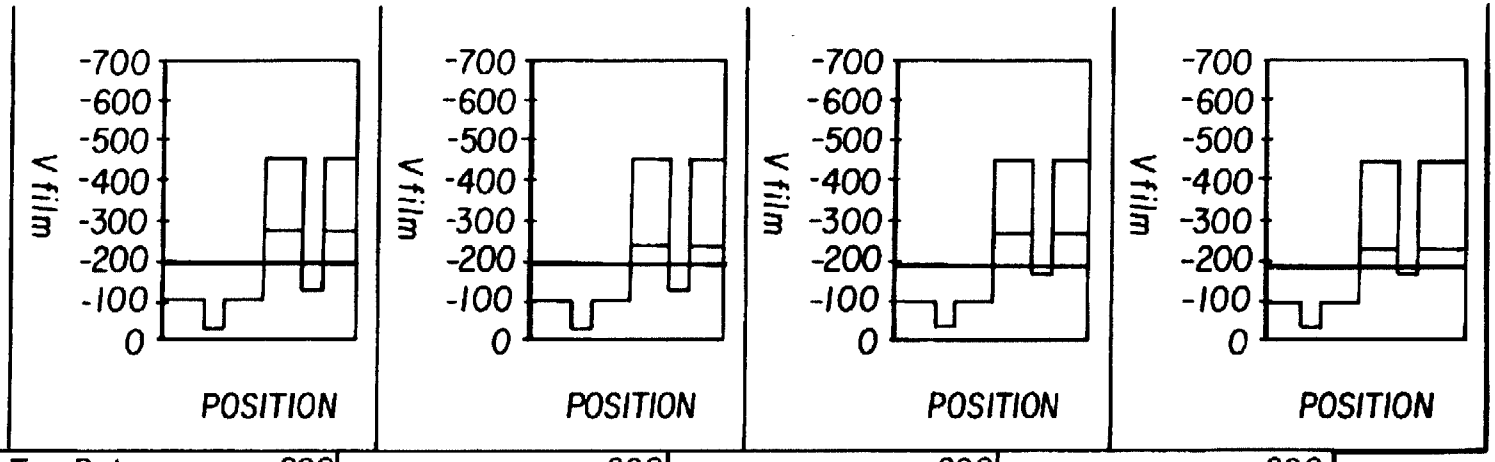

FIGS. 7 and 8 illustrate the use of an AC bias on the development stations in conditions of high Q/M for the toner in that station to increase development completion to make up for some of the loss in density occasioned by the high charge. Note that the conditions in FIG. 7 illustrate good density results with the Q/M of the black toner varying from −19 to −25.8 and the color toner varying from 19 to 24.4 without the use of variation in $V_0$ and without the use of the electroluminescent panel. This is an improvement on the results in FIGS. 2–5 but does not really provide as broad a range as did variation in $V_0$ with the electroluminescent panel. This is further illustrated in FIG. 8 in which more marginal results are obtained as the Q/M for the black toner is varied from −16 to −29.5 while the Q/M for the color toner is varied from 13.2 to 30.5. Note also that the scavenging potential in each instance is less than desired when the black toner is in a condition of high charge. It should be emphasized, however, that this is a distinct improvement over no control at all, as shown in FIGS. 2 and 3.

Figures 9, 9A, 9B:
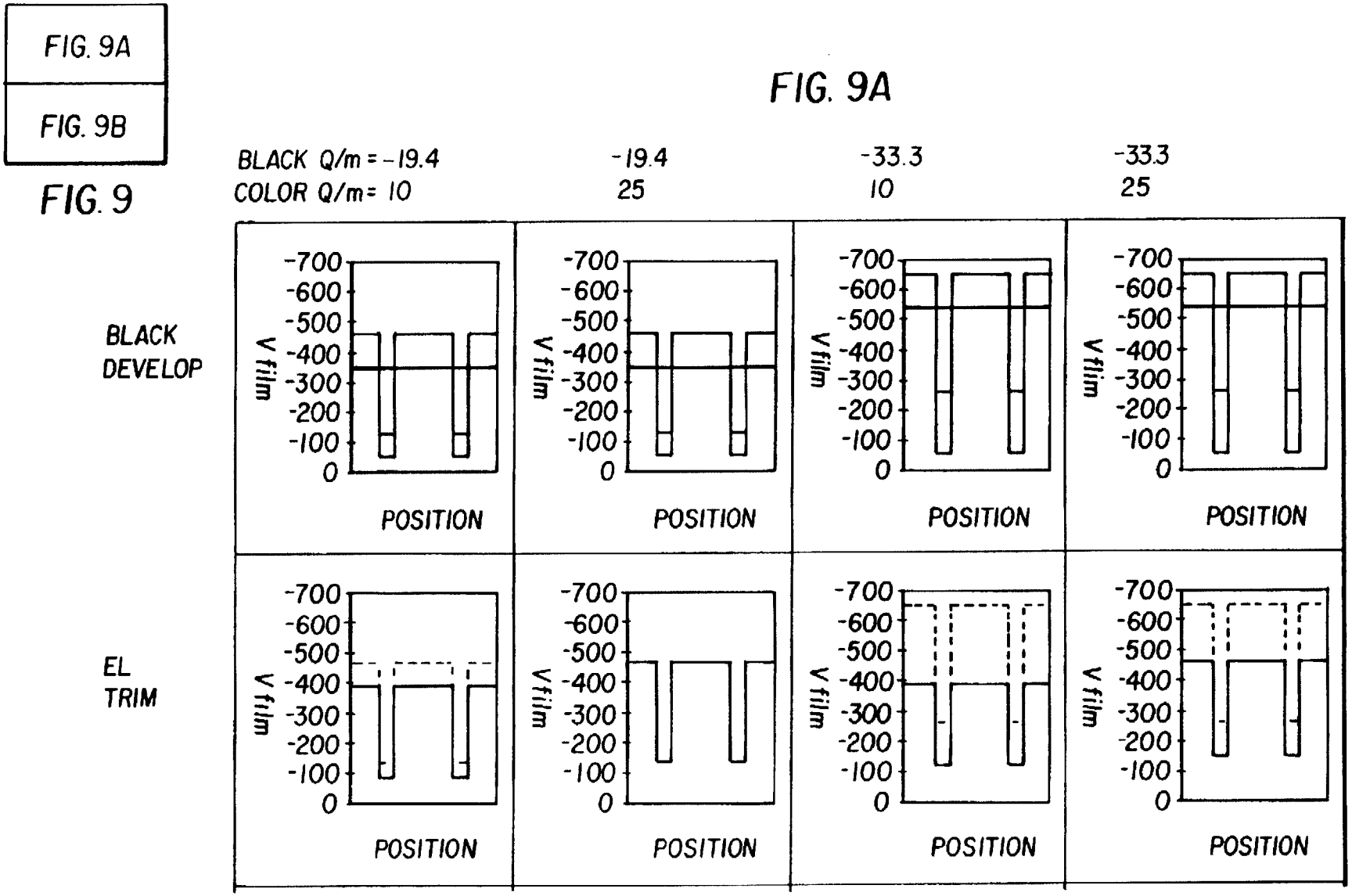
Figure 9B:
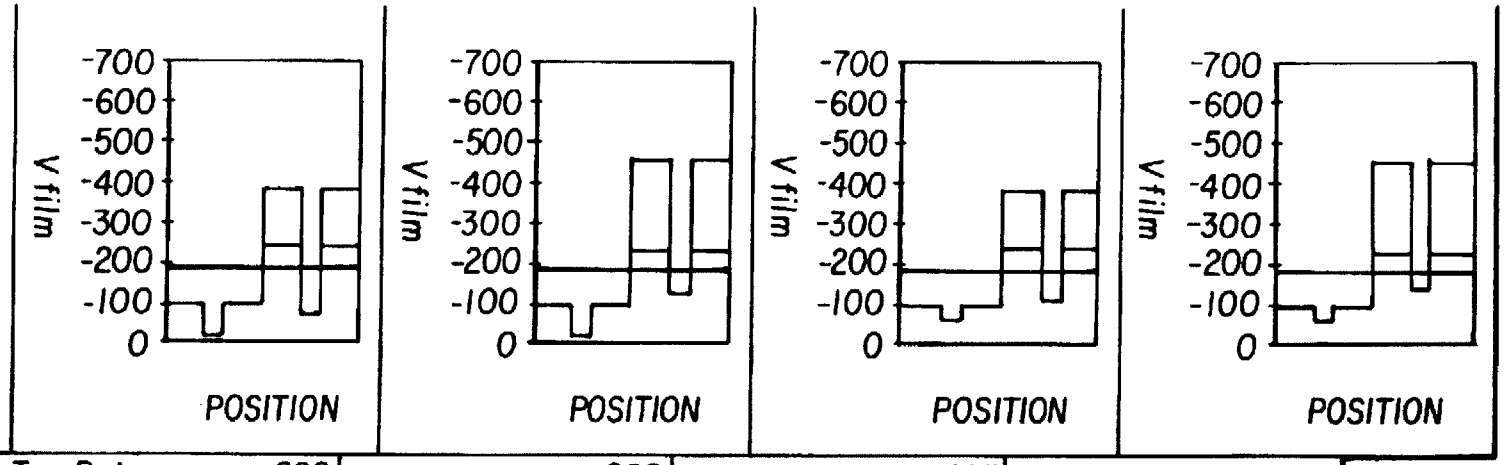
Figures 10, 10A, 10B:
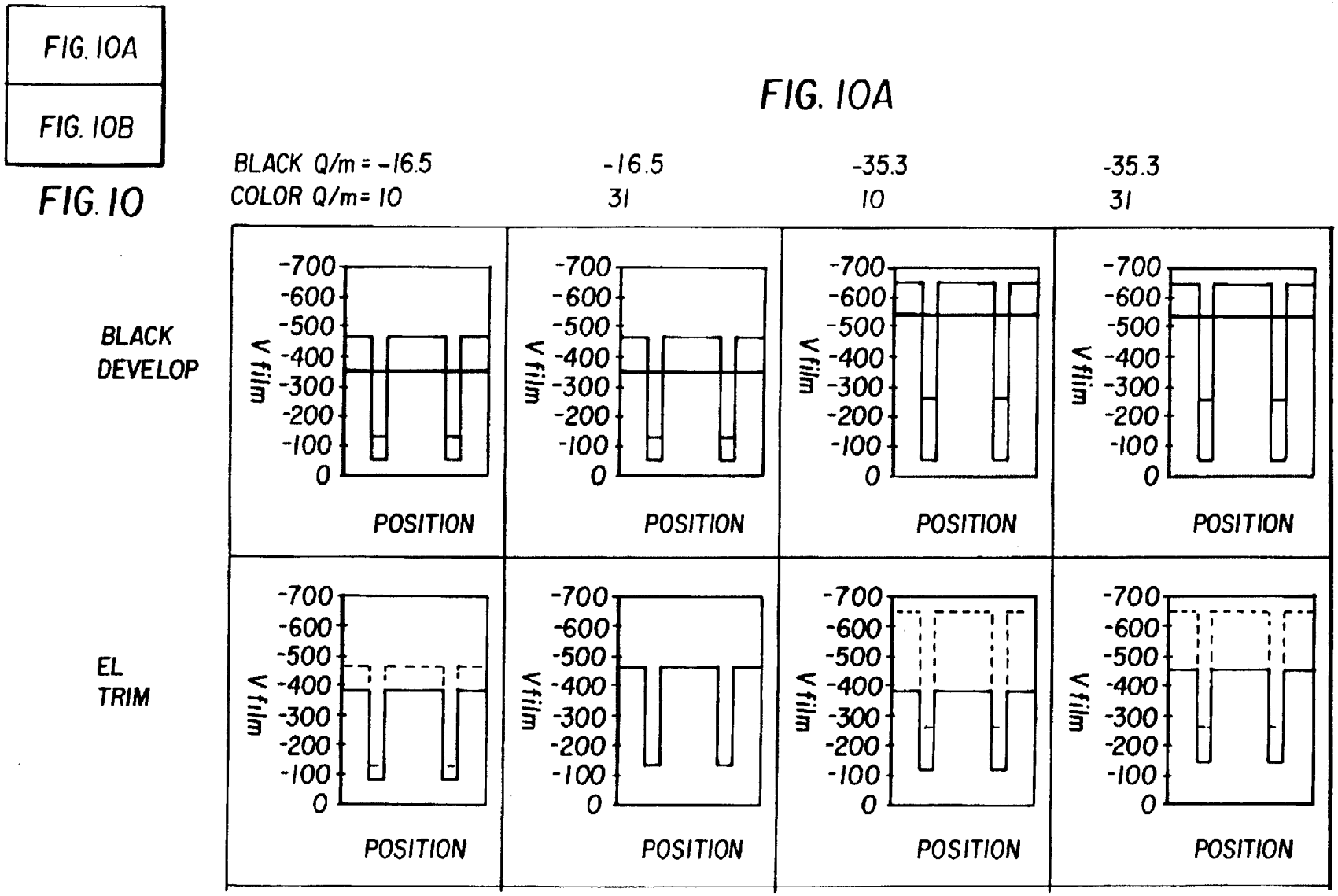
Figure 10B:
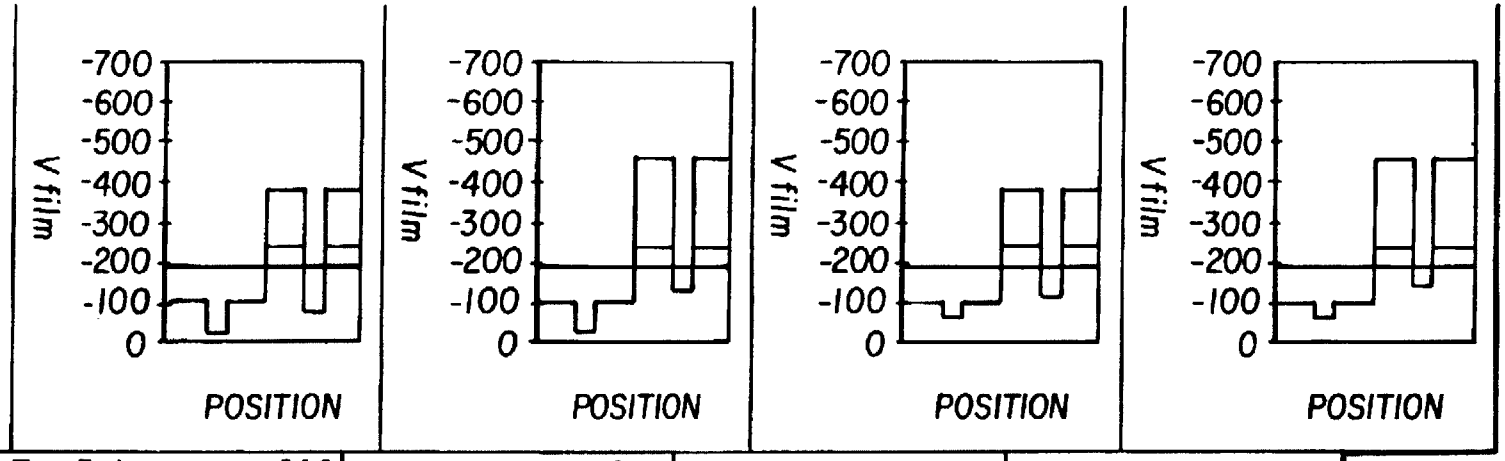

FIGS. 9 and 10 illustrate the use of all of the features of the earlier FIGS. in combination. That is, pole transitions per second in the black station are fixed at substantially less than those in the color station, and variable $V_0$, variable EL trim and variable AC bias are all used together. FIG. 9 illustrates that excellent density results can be achieved for both the black and the color stations with a variation in the Q/M of the black toner from −19.4 to −33.3 μC/g and a variation in the Q/M of the color toner from 10 to 25 μC/g. FIG. 10 demonstrates marginally acceptable results as the black Q/M is varied from −16.5 to −35.3 and the color Q/M is varied from 10 to 31. In both sets of examples, at the conditions of highest Q/M, the disruption potential is marginal. (This is discussed further with respect to FIGS. 11 and 12). However, the data clearly demonstrates the robustness of the control method used. Each of the adjustable parameters can be used separately to advantage. When used together, the result is considerably better.

Figures 11, 11A, 11B:
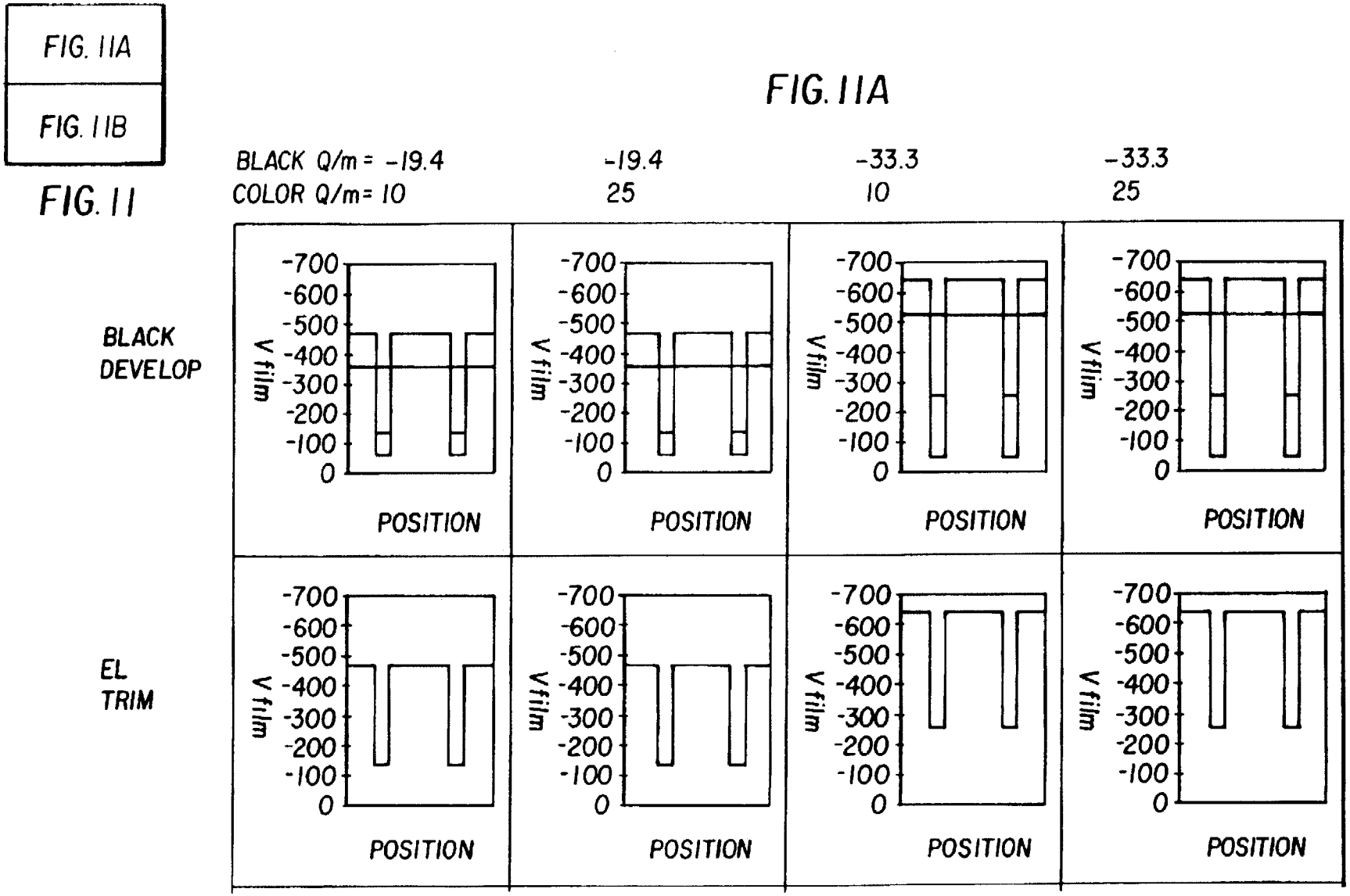
Figure 11B:
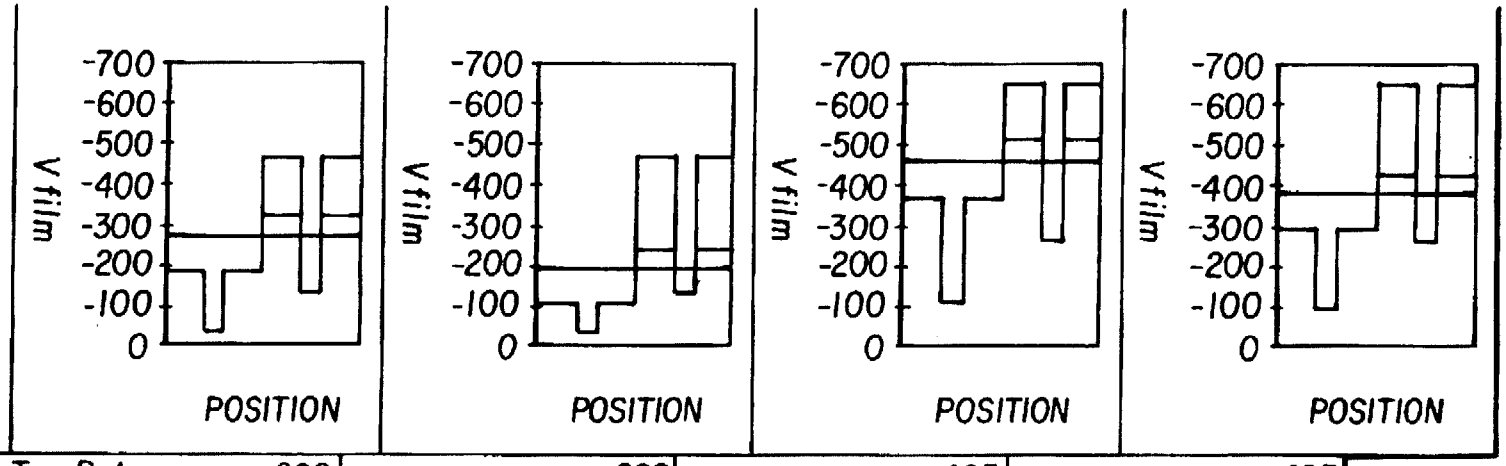

FIG. 9 shows excellent density results over a fairly broad range of toner Q/M. However, as pointed out above, the disruption potential around 35 volts is marginal at the high black Q/M. According to another preferred embodiment, rather than reduce the acceptable toner Q/M range, both the him exposure and $V_b'$ can be adjusted. This is illustrated by reference to FIGS. 11 and 12. FIG. 11 illustrates accommodation of the same Q/M range illustrated in FIG. 9 but without the use of the EL panel at all. In this case, the color exposure intensity is used to control $V_e'$, and $V_b'$ is set to a voltage which is a constant offset from $V_e'$. For example, referring to the third and fourth columns of FIG. 11, $V_b'$ is set at −460 volts and −390 volts, respectively. This approach provides comparable densities to those in FIG. 9 and extremely large scavenging and disruption potentials. However, it is accompanied by extremely high background potentials of 380 volts and 290 volts, respectively, for the color development system in areas containing a black image. Such high background potentials can create a problem with many systems in terms of carrier deposition by the color development system in the black image areas.

Figures 12, 12A, 12B:
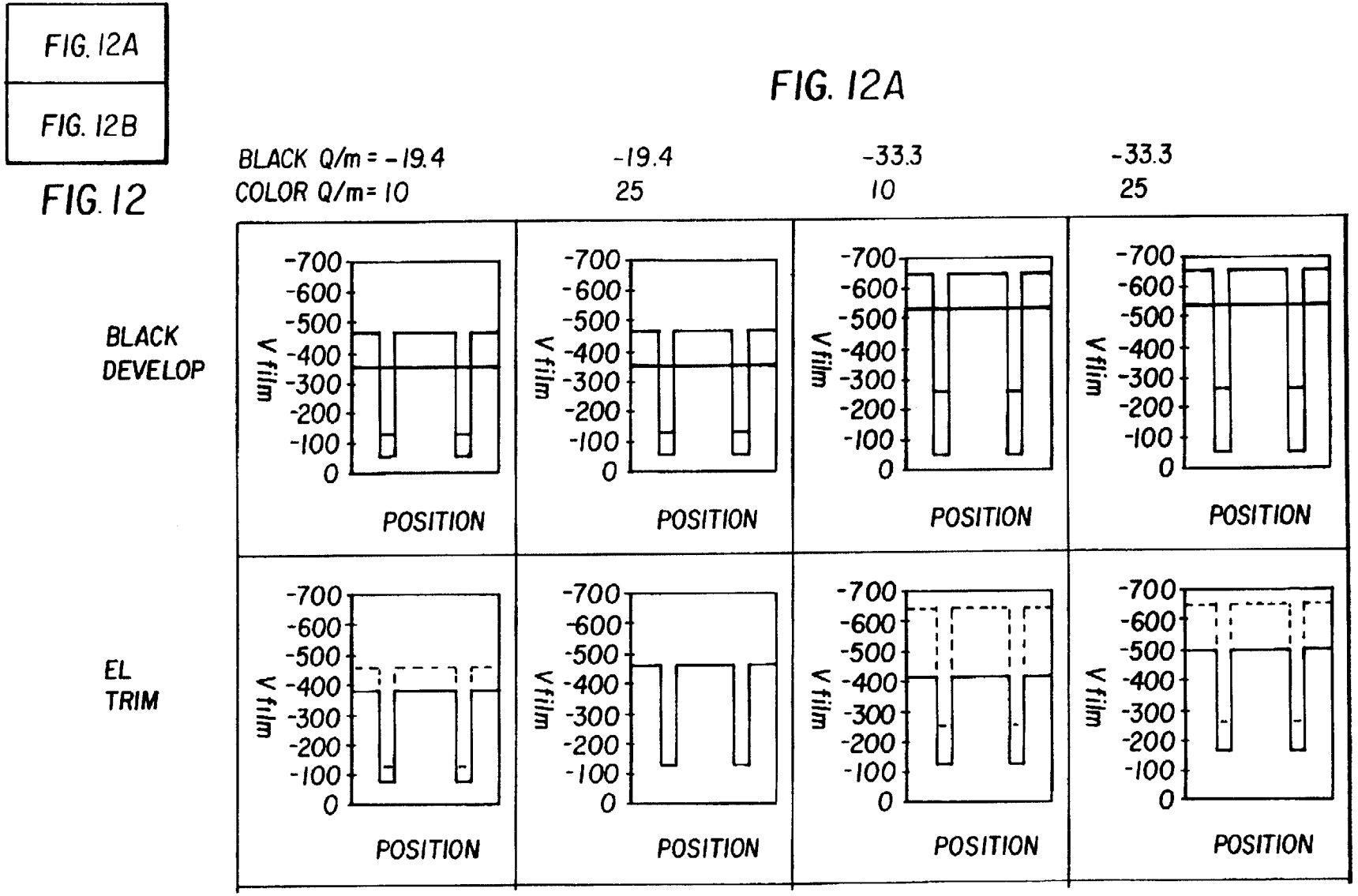
Figure 12B:
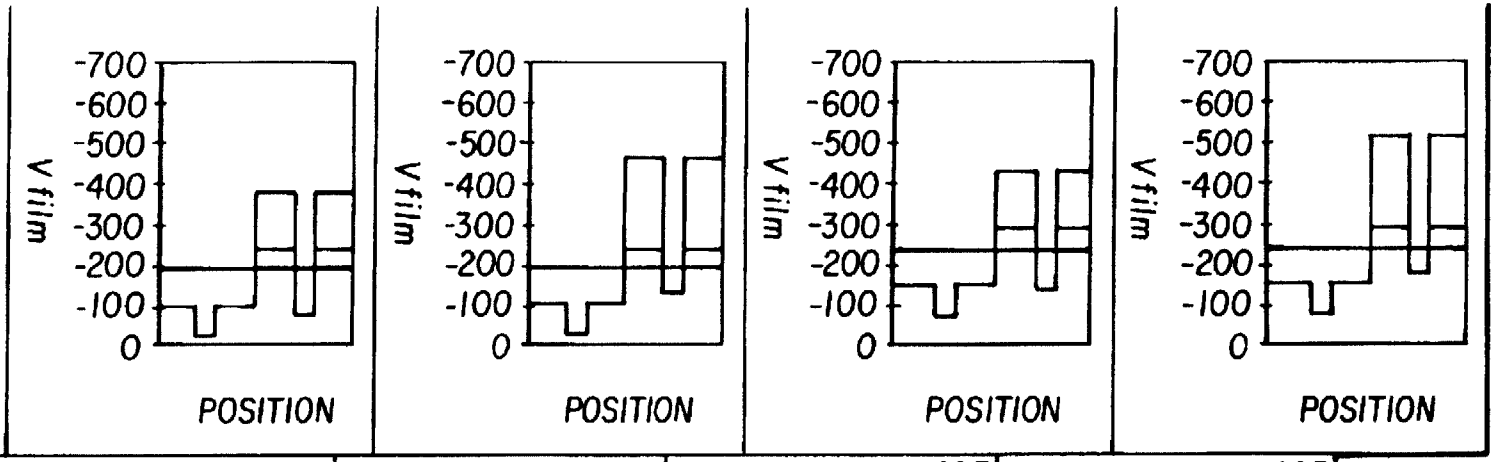

FIG. 12 shows a compromise solution to this problem in which the magnitude of the EL panel exposure is made greatest with a high black Q/M and a low color Q/M and somewhat less with a high black Q/M and a high color Q/M. At the same time, the $V_b'$ is raised just enough to provide a disruption potential of 75 volts. Although, again, these numbers are best determined empirically, a preferred approach is to start with a $V_b'$ that provides a satisfactory disruption potential (preferably between 60 and 90 volts) and then derive the EL exposure according to the density provided by the materials with that $V_b'$.

In all instances, the description of the trim exposure is assumed to be accomplished by the EL panel 5 on the backside of the image member 20. However, this trim could be readily built into the exposure values of printhead 7, thereby eliminating the backside EL panel. The desirability of using the printhead 7 for this function depends upon the reliability of the printhead with this extra use and the cost and hardware space saving from eliminating the EL panel. Using the printhead has an additional advantage that, in some instances, it can be varied according to the image to provide more control flexibility. For example, disruption and scavenging can be improved with a trim exposure that is more powerful in the black image areas (to the extent registration permits).

Note that the DAD-CAD system is made more robust by construction or set up with low development completion in the first toning station and high development completion in the second station. To accomplish this aspect of the invention, the toning completion $$\frac{V_d - V_e}{V_b - V_e}$$

for the first station (the black image) should be less than 0.4, and preferably less than 0.3, for most Q/M values of the black toner. Although other means can be used, in the preferred embodiments, this is accomplished by a fixed lower pole transition rate in the first station than in the second station. This provides room in the potential graph for the color image formation and for a scavenging resisting potential $V_b'-V_{del}$. In the examples, AC bias increase is used to increase development completion to control density in high Q/M situations. This is a different use of development completion and has a tendency to cramp the voltage provided by the low pole transitions in the first station, but it is useful in expanding system use into difficult high Q/M situations.

Since resistance to scavenging is affected by the bias $V_b'$ in the second toning station 8, having $V_b'$ relatively high is useful. For this reason, a high development or toning completion in the second station is desirable. Ideally, the development completion of the second image is at least twice that of the first. The toning or development completion of the second toning step is equal to $$\frac{V_0' - V_d'}{V_0' - V_b'}$$

and should be greater than 0.6, preferably greater than 0.7 for most Q/M values of the color toners. Using pole transitions, it is preferable that the number of pole transitions to which the developer is subjected in applying the first toner is less than 60 percent that in applying the second toner.

According to another preferred embodiment, not illustrated in the drawings, the pole transitions per second of the magnetic core in each of the stations are made variable by varying the speed of rotation. For example, the speed of the core 33 in the first station 3 is increased in conditions of high black Q/M. This provides a substitute, at least in part, for the AC bias in controlling development completion in conditions of varying charge-to-mass. The actual examples illustrated in the drawings (using a varying AC bias) are preferred because of the simplicity and ease of the electrical adjustments compared to changing the speed of the core. Since these development stations work best with the developer moving at the same speed as the image member, a change in the speed of the core is preferably compensated for by an offsetting change in the speed of the shell. Use of core-shell rotation in process control generally is described in U.S. Pat. Nos. 4,473,029, Fritz et al, issued Sep. 25, 1984; and 4,531,832, Kroll et al, issued Jul. 30, 1985.

Although possible, it is not usually practical to measure directly the charge-to-mass ratio of toner in an electrophotographic apparatus. However, it can be determined indirectly by toner image density observations. Therefore, this process control, like other process controls well known in the art, is best operated with a control patch. Conventionally, a patch of photoconductive image member between image frames is charged and exposed to a particular level and then toned. The density of the toned patch is measured by a densitometer 21 (see FIG. 1) which then feeds that measurement back to logic and control 100 and compares the density reading with a nominal density reading and adjusts the parameters of the system according to the difference. It repeats the monitoring of the control patch until the density is within a desired range. A separate patch is used for each of black and color toners. Although other parameters, such as toner concentration, can also affect patch density in a well controlled system it provides a reliable way of monitoring Q/M.

For example, if a reading on the black patch indicated that the density was too light, both $V_0$ and the AC bias on the first or black development station would be increased and the exposure from the electroluminescent panel increased. If the color patch shows less density than desired, the electroluminescent panel can be decreased in output and the AC bias on the color development station increased. In this example, the pole transitions on the magnetic brush cores are constant, as in the FIGS., but rotation of the core (and shell) could be made dependent upon the densitometer reading as well.

Although formulas could be worked out for specific apparatus and materials, as a practical matter, lookup tables and the like associated with control of this process are developed empirically from data similar to that shown in the FIGS.

Although the principles are the same whether the system is operating with a binary or a multiple level exposure, the multiple level exposure is considerably more challenging because substantial range of voltages are required in each electrostatic image in such a system. This restricts flexibility naturally available in a binary system as charge-to-mass of the toner varies.

The invention has been described in detail with particular reference to a preferred embodiment thereof, but it will be understood that variations and modifications can be effected within the spirit and scope of the invention as described hereinabove and as defined in the appended claims.

I claim:

1. An image forming method comprising:

uniformly charging a photoconductive image member to a charge of a first polarity and a first potential $V_0$;

imagewise exposing the image member to form a first electrostatic image, said first electrostatic image having a minimum potential $V_e$;

using a first toning station, applying a first toner of the first polarity to the first electrostatic image to form a first toner image of the first polarity in the presence of an electric field controlled by a bias $V_b$ associated with the first toning station, the first toner image having a maximum potential $V_d$;

imagewise exposing the image member to form a second electrostatic image of the first polarity;

using a second toning station, applying a second toner to the second electrostatic image in the presence of an electric field controlled by a bias $V_b'$, associated with the second toning station, the second toner being of a second polarity opposite the first polarity, to form a second toner image having a potential at its maximum density of $V_d'$;

characterized in that the step of applying a first toner is carried out under conditions providing a development completion of the first toner image equal to less than 0.4, where development completion is equal to $$\frac{V_d - V_e}{V_b - V_e}.$$

2. The image forming method according to claim 1 wherein said step of applying a first toner provides a development completion of the first toner image equal to less than 0.3.

3. The image forming method according to claim 2 wherein the step of applying the second toner provides a development completion $$\frac{V_0' - V_d'}{V_0' - V_b'}$$

greater than 0.7, where $V_0'$ is the highest voltage in the second electrostatic image.

4. The method according to claim 3 wherein the difference between $V_{de}$ and $V_e'$ is at least 50 volts, where $V_{de}$ is the potential of the first toner image after exposure of the second electrostatic image and $V_e'$ is the lowest potential in the untoned areas of the first electrostatic image after exposure of the second electrostatic image.

5. The method according to claim 3 wherein the difference between $V_b'$ is at least 50 volts in scalar quantity higher than $V_{del}$ where $V_{del}$ is the potential of areas of the second electrostatic that contain toner from the first toner image but are not exposed in creating the second electrostatic image.

6. The image forming method according to claim 1 wherein the step of applying the second toner provides a development completion $$\frac{V_0' - V_d'}{V_0' - V_b'}$$

greater than 0.6, where $V_0'$ is the highest voltage in the second electrostatic image.

7. The image forming method according to claim 6 wherein said step of applying the second toner image provides a development completion greater than 0.7.

8. The image forming method according to claim 6 wherein each of the steps of applying the first and second toners includes moving a developer of toner and hard magnetic carrier through a development zone while subjecting the developer to a given number of magnetic pole transitions per second and wherein the number of pole transitions per second for the step of applying the first toner is substantially less than that for applying the second toner.

9. The method according to claim 6 wherein a difference between $V_{de}$ and $V_e'$ is between 60 and 90 volts, where $V_{de}$ is the potential of the first toner image after exposure of the second electrostatic image and $V_e'$ is the lowest potential in the untoned areas of the first electrostatic image after exposure of the second electrostatic image.

10. The image forming method according to claim 1 wherein each of the steps of applying the first and second toners includes moving a developer of toner and hard magnetic carrier through a development zone while subjecting the developer to a given number of magnetic pole transitions per second and wherein the number of pole transitions per second for the step of applying the first toner is substantially less than that for applying the second toner.

11. The method of claim 3 wherein the number of pole transition to which the developer is subjected to in applying the first toner is less than 60 percent that in applying the second toner.

12. The image forming method according to claim 10 wherein the number of pole transitions per second to which the developer is subjected in the step of applying the first toner is less than 60 percent of the number to which the developer is subjected in the step of applying the second toner.

13. The image forming method according to claim 1 wherein the step of applying the first toner includes applying an AC component to the electrical field while applying the first toner and further includes the step of controlling development completion in applying the first toner by varying the AC component according to a monitored parameter associated with the first toner.

14. The image forming method according to claim 13 wherein the monitored parameter is the charge to mass ratio of the first toner and it is monitored by sensing the density of a toner patch on the image member created for that purpose and from which said ratio can be inferred.

15. The image forming method according to claim 1 further including the step of reducing the potential on the image member after formation of the first toner image and before application of the second toner.

16. The image forming method according to claim 15 wherein the step of reducing the charge includes exposing the image member to a uniform level of illumination.

17. The image forming method according to claim 16 wherein said exposure to uniform illumination is made from a side of the image member opposite the first toner image.

18. The image forming method according to claim 15 wherein the step of reducing the charge is accomplished at the same time as the step of imagewise exposing the image member to form a second electrostatic image.

19. The method of claim 1 and wherein the first toner is developed in relatively discharged areas of the first electrostatic image and the second toner is developed in relatively charged areas of the second toner image.

20. The method of claim 19 wherein between the first toning station and the second toning station no charge is added to a surface of the image member that is developed with the first toner image.

21. An image forming method comprising:

uniformly charging a photoconductive image member to a charge of a first polarity;

imagewise exposing the image member to form a first electrostatic image;

applying a first toner of the first polarity to the first electrostatic image to form a first toner image of the first polarity;

imagewise exposing the image member to form a second electrostatic image of the first polarity;

applying a second toner to the second electrostatic image, the second toner being of a second polarity opposite the first polarity, to form a second toner image of the second polarity;

characterized in that said steps of applying first and second toners each include moving a developer of toner and hard magnetic carrier through a development zone while subjecting the developer to a number of magnetic pole transitions per second and wherein the number of pole transitions per second for the step of applying the first toner is substantially less than that for applying the second toner.

22. The image forming method according to claim 21 wherein the step of imagewise exposing the image member to form a second electrostatic image includes exposing the image member from a side of the image member opposite the toner image.

23. The method according to claim 21 further including the step of uniformly reducing the charge on the image member after formation of the first toner image.

24. The method of claim 21 wherein in the step of applying the second toner an electrical field between a development station that applies the toner and the image member is established by a source of potential that has DC and AC components.

* * * * *